US010946672B2

(12) United States Patent
Hu et al.

(10) Patent No.: US 10,946,672 B2
(45) Date of Patent: Mar. 16, 2021

(54) PRINTED HEATING ELEMENT

(71) Applicant: Goodrich Corporation, Charlotte, NC (US)

(72) Inventors: Jin Hu, Hudson, OH (US); David B. Sweet, Canal Fulton, OH (US)

(73) Assignee: GOODRICH CORPORATION, Charlotte, NC (US)

( * ) Notice: Subject to any disclaimer, the term of this patent is extended or adjusted under 35 U.S.C. 154(b) by 431 days.

(21) Appl. No.: 16/012,119

(22) Filed: Jun. 19, 2018

(65) Prior Publication Data

US 2019/0023030 A1 Jan. 24, 2019

Related U.S. Application Data

(62) Division of application No. 13/866,665, filed on Apr. 19, 2013, now Pat. No. 10,071,565.

(60) Provisional application No. 61/636,545, filed on Apr. 20, 2012.

(51) Int. Cl.

| | |
|---|---|
| ***B41J 11/00*** | (2006.01) |
| ***H05B 3/22*** | (2006.01) |
| ***H05B 3/12*** | (2006.01) |
| ***B41J 3/407*** | (2006.01) |
| ***H05B 3/34*** | (2006.01) |

(52) U.S. Cl.

CPC ..... *B41J 11/0015* (2013.01); *B41J 3/407* (2013.01); *H05B 3/12* (2013.01); *H05B 3/22* (2013.01); *H05B 3/34* (2013.01); *H05B 2203/013* (2013.01); *H05B 2203/017* (2013.01); *H05B 2214/04* (2013.01)

(58) Field of Classification Search

CPC ..... B41J 3/407; B41J 11/0015; H05B 3/34; H05B 2214/04; H05B 2203/017; H05B 2213/013; H05B 3/22; H05B 3/12

See application file for complete search history.

(56) References Cited

U.S. PATENT DOCUMENTS

| | | | |
|---|---|---|---|
| 3,579,459 | A | 5/1971 | Porta et al. |
| 3,857,798 | A | 12/1974 | Wall et al. |
| 5,897,912 | A | 4/1999 | Shaikh |
| 6,432,585 | B1 | 8/2002 | Kawakami et al. |
| 2006/0163744 | A1 | 7/2006 | Vanheusden et al. |
| 2008/0136861 | A1 | 6/2008 | Free et al. |

(Continued)

FOREIGN PATENT DOCUMENTS

| | | | |
|---|---|---|---|
| CN | 2053418 | U | 2/1990 |
| CN | 1053986 | A | 8/1991 |

(Continued)

OTHER PUBLICATIONS

EP Search Report for EP Application No. 13164384.3; dated Aug. 16, 2013.

(Continued)

*Primary Examiner* — Dana Ross
*Assistant Examiner* — Kuangyue Chen
(74) *Attorney, Agent, or Firm* — Cantor Colburn LLP

(57) ABSTRACT

A heating element is provided with a conductive path pattern which can be printed in a mask-free manner (e.g., drop-on-demand) with existing printing technology. The printing step can be performed, for example, with a thermal inkjet printer, a piezoelectric inkjet printer, an aerosol jet printer, or an ultrasound printer. The ink solution can be formulated so that it establishes an electrically conductive path which is free of polymer binders.

8 Claims, 35 Drawing Sheets

(56) References Cited

U.S. PATENT DOCUMENTS

| | | | |
|---|---|---|---|
| 2009/0274833 | A1 | 11/2009 | Li et al. |
| 2010/0000762 | A1 | 1/2010 | Yang et al. |
| 2010/0065542 | A1 | 3/2010 | Dubey |
| 2011/0042370 | A1 | 2/2011 | Choi et al. |
| 2014/0071216 | A1 | 3/2014 | Hu et al. |

FOREIGN PATENT DOCUMENTS

| | | | |
|---|---|---|---|
| CN | 1536587 | A | 10/2004 |
| CN | 1615049 | A | 5/2005 |
| CN | 101978776 | A | 2/2011 |
| WO | 2009050519 | A1 | 4/2009 |
| WO | 2011065709 | A2 | 6/2011 |

OTHER PUBLICATIONS

BR Office Action for Brazilian Patent Application No. BR 10 2013 009676 8, dated Jan. 5, 2021, 4 pages.

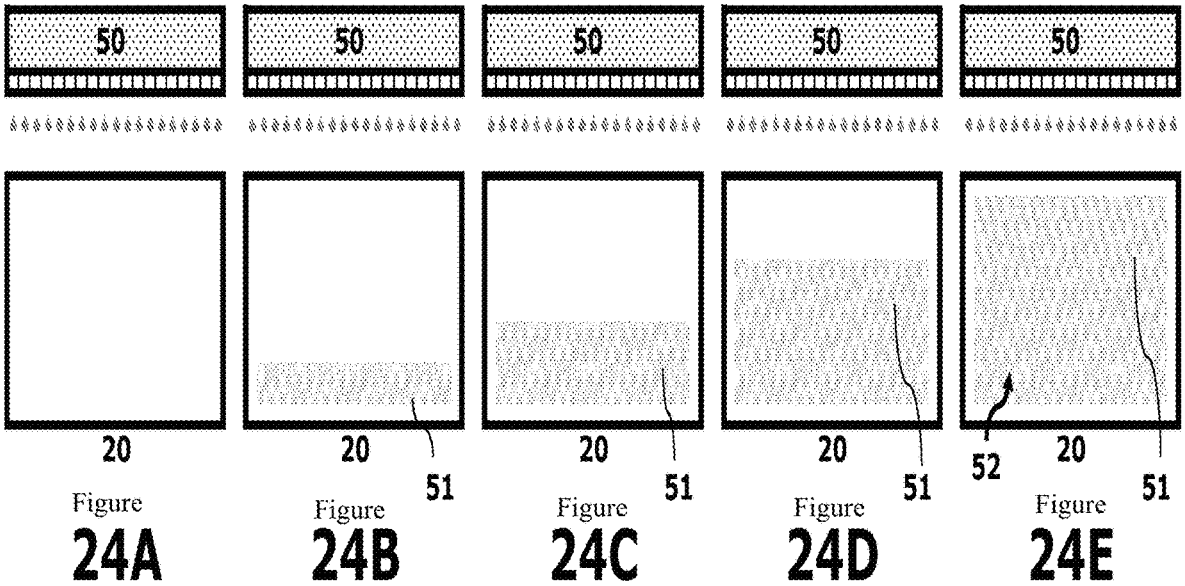
50
20
Figure 24A
50
20
51
Figure 24B
50
20
51
Figure 24C
50
20
51
Figure 24D
50
52
20
51
Figure 24E
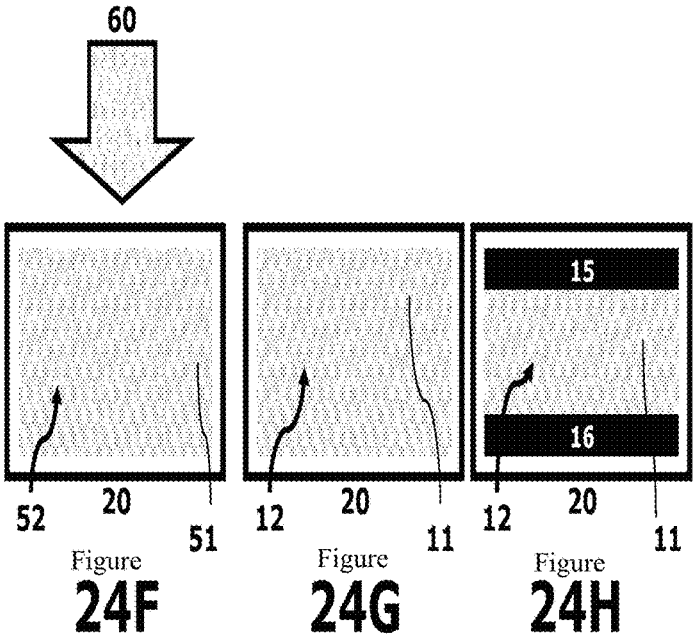
60
52
20
51
Figure 24F
12
20
11
Figure 24G
15
16
12
20
11
Figure 24H

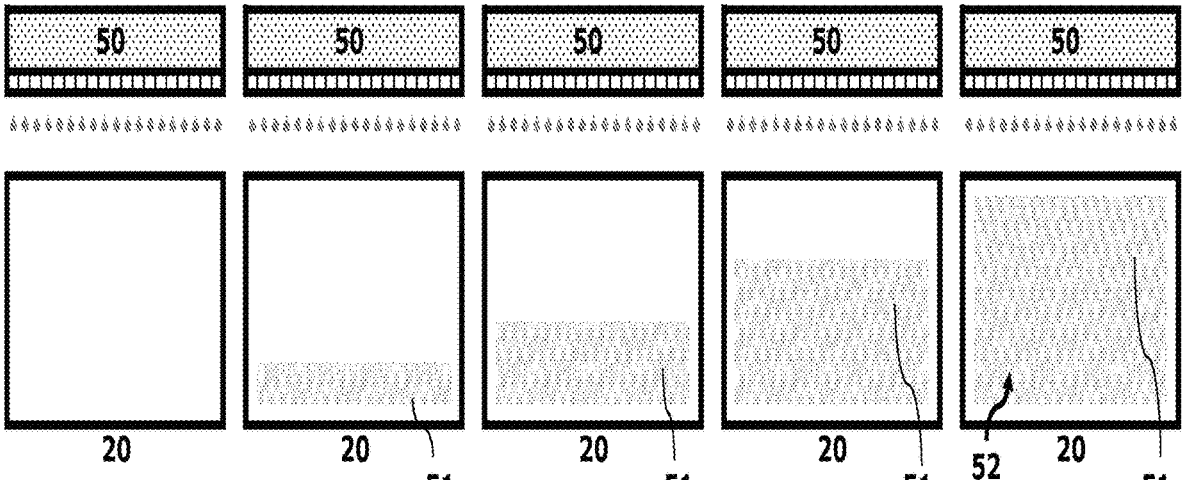
Figure 26A
Figure 26B
Figure 26C
Figure 26D
Figure 26E
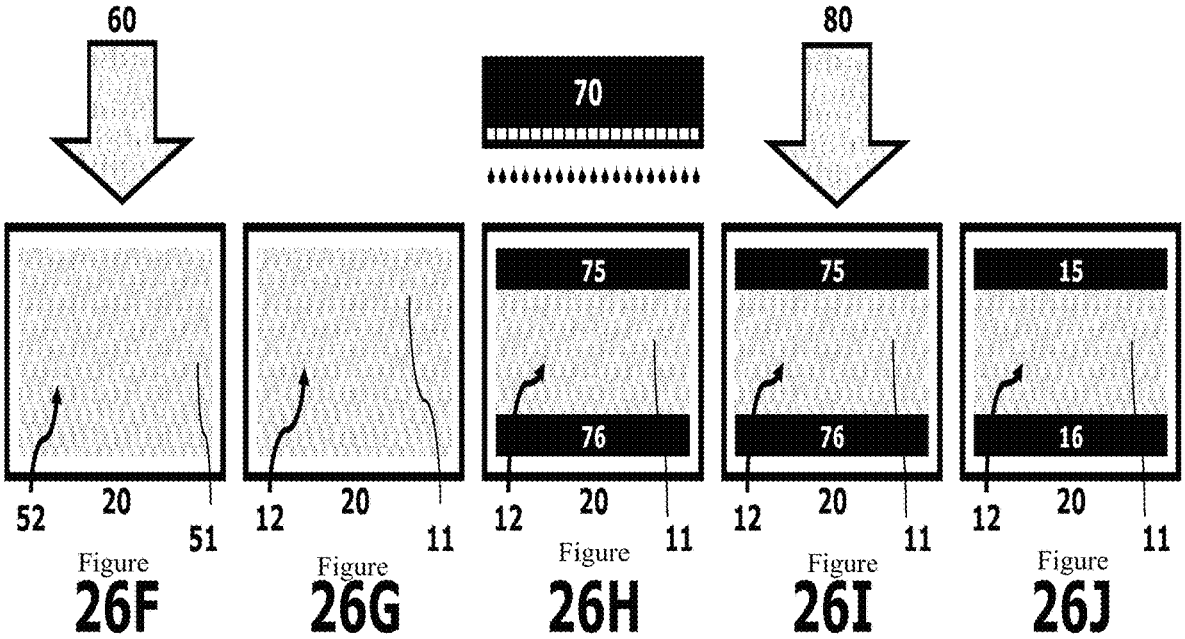
Figure 26F
Figure 26G
Figure 26H
Figure 26I
Figure 26J

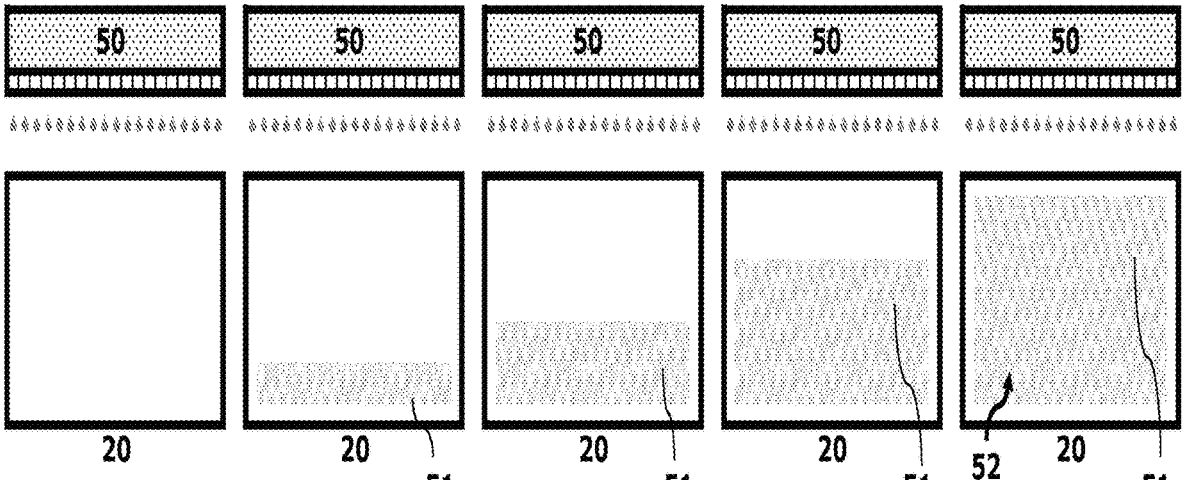
Figure 28A
Figure 28B
Figure 28C
Figure 28D
Figure 28E
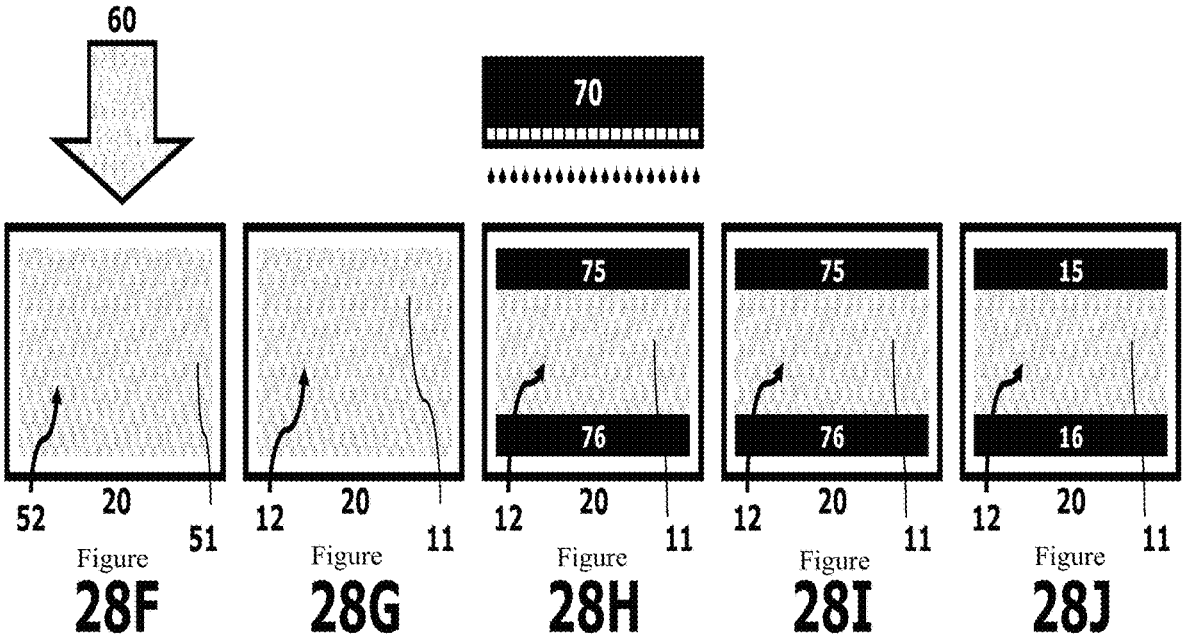
Figure 28F
Figure 28G
Figure 28H
Figure 28I
Figure 28J 50
20

51

52

60
70
80
75
76
77
78
15
16
12
11

PRINTED HEATING ELEMENT

CROSS-REFERENCE TO RELATED APPLICATIONS AND PRIORITY CLAIM

This application is a divisional of U.S. application Ser. No. 13/866,665 filed Apr. 19, 2013, which claims priority under 35 U.S.C. 119(e) to U.S. Provisional Patent Application No. 61/636,545, filed Apr. 20, 2012, entitled "PRINTED HEATING ELEMENT", which are incorporated herein by reference in their entirety.

BACKGROUND OF THE INVENTION

A heating element converts electricity into heat through the process of ohmic heating wherein the passage of an electric current through a conductive path releases heat. Conductive paths have conventionally been formed by wires, etched foils, or screen-printed tracks made from a conductive material.

BRIEF DESCRIPTION OF THE INVENTION

A heating element is provided with a conductive path pattern which can be printed in a mask-free manner (e.g., drop-on-demand) with existing printing equipment.

In one embodiment, a heating element adapted to provide a power density of at least 400 watts per square meter is disclosed. The heating element of this embodiment includes at least one printed track establishing an electrically conductive path free of polymer binders inside the path, wherein each track establishes a particle-free metal compound path or each track establishes a nanometal path, a nanometals path, or a nanometal oxide path.

In another embodiment, a method of making a heating element adapted to provide a power density of at least 400 watts per square meter is disclosed. The method includes printing a trail with an ink solution for each track in the pattern. The ink solution includes: a particle-free metal compound and a solvent in which the particle-free metal compound is dissolved; or nanometal, nanometal, or nanometal oxide particles and a solvent in which the particles are dispersed; or carbon nanotubes and a solvent in which the carbon nanotubes are dispersed.

BRIEF DESCRIPTION OF THE DRAWINGS

FIGS. 23A-35J show methods of making printed heating elements.

DETAILED DESCRIPTION OF THE INVENTION

Figure 1:
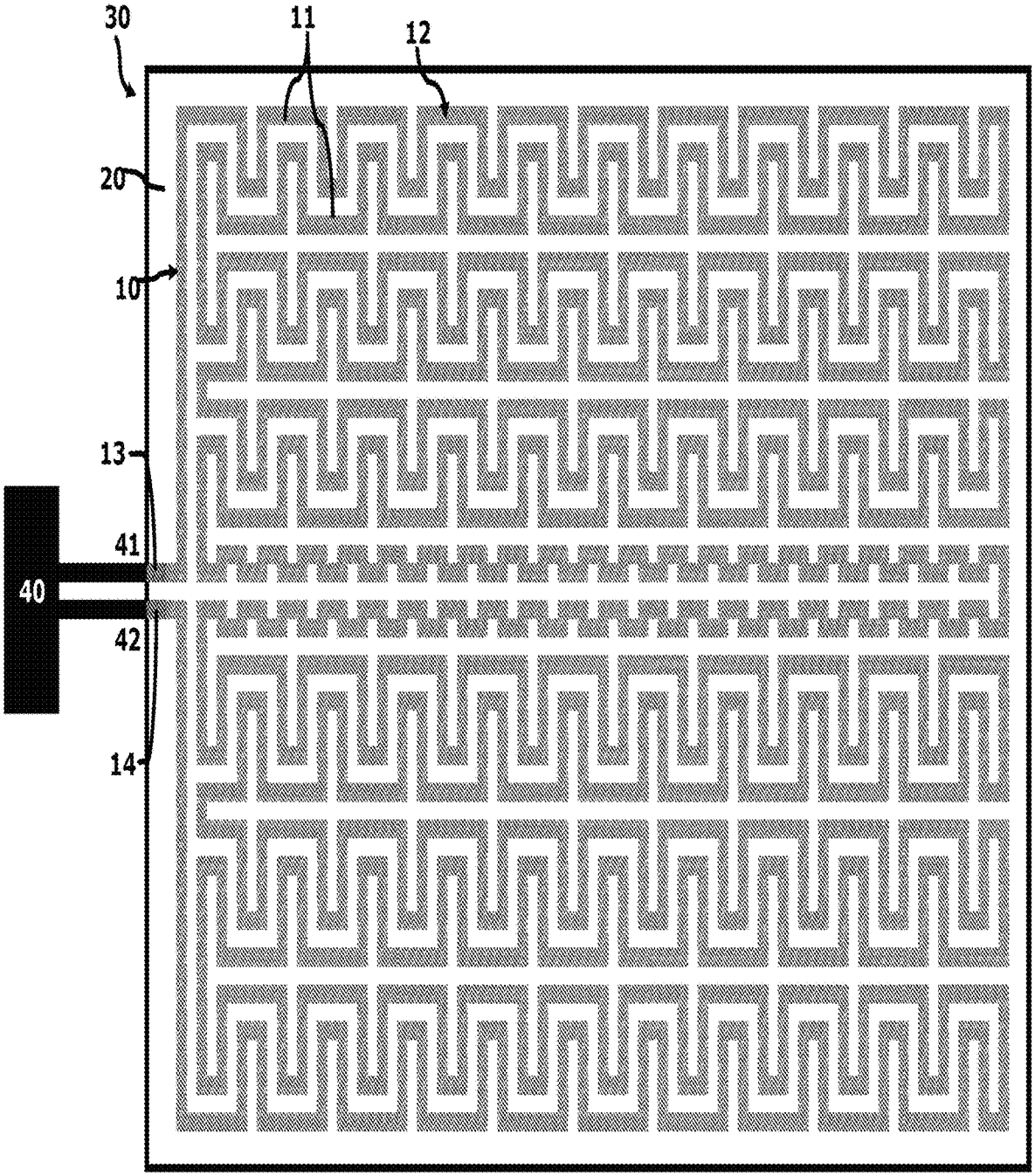
FIGS. 1-21 show various embodiments of printed heating elements.

Referring now to the drawings, and initially to FIGS. 1-9, heating elements 10 are shown which is adapted to provide a power density of more than 400 watts per square meter. Each heating element 10 comprises at least one printed track 11 which establishes an electrically conductive path free of polymer binders inside the path. The tracks 11 are arranged in a pattern 12 appropriate to accomplish the desired heating function.

The tracks 11 can establish a particle-free metal compound path. Alternatively the tracks 11 can establish a nanometal path, a nanometals path, a nanometal oxide path. If so, each track 11 can contain platinum, silver, silver oxides, gold, copper, and/or aluminum conductive alloys. Non-metal-containing tracks 11 are also possible such as, for example, a track 11 establishing a nanocarbon path.

The heating element 10 can be carried on a substrate 20 and/or incorporated into a heater 30. The heater 30 is supplied with electric power from a source 40 which includes a supply lead 41 and a return lead 42 electrically connected to the heating element 10. Although the substrate 20 and the heater 30 are depicted as being planar in the drawings, this is not necessarily the case. One advantage of the heating element 10, and particularly the fact that its tracks 11 can be printed, is the ability to construct printing equipment to accommodate the complex surface contours often encountered in, for example, the aerospace industry.

The substrate 20 can be, for example, a dielectric polymer film which can be installed onto the desired to-be-heated surface. This film can be rigid with a shape corresponding to that of the to-be-heated surface, or it can be flexible to conform to the surface shape upon installation. Alternatively, the substrate can constitute a surface integral with the to-be-heated component. Another advantage is the ability to directly print the tracks 11 during manufacturing phases of the to-be-heated component.

Other layers, not shown in the drawings, can be incorporated into the heating element 10, the substrate 20, and/or the heater 30. For example, a polymer adhesive can used to enhance attachment of the printed pattern 12 to the substrate 20 (but not to establish the electrical path). Additionally or alternatively, a polymer adhesive could be place over the printed pattern 12.

Figure 2:
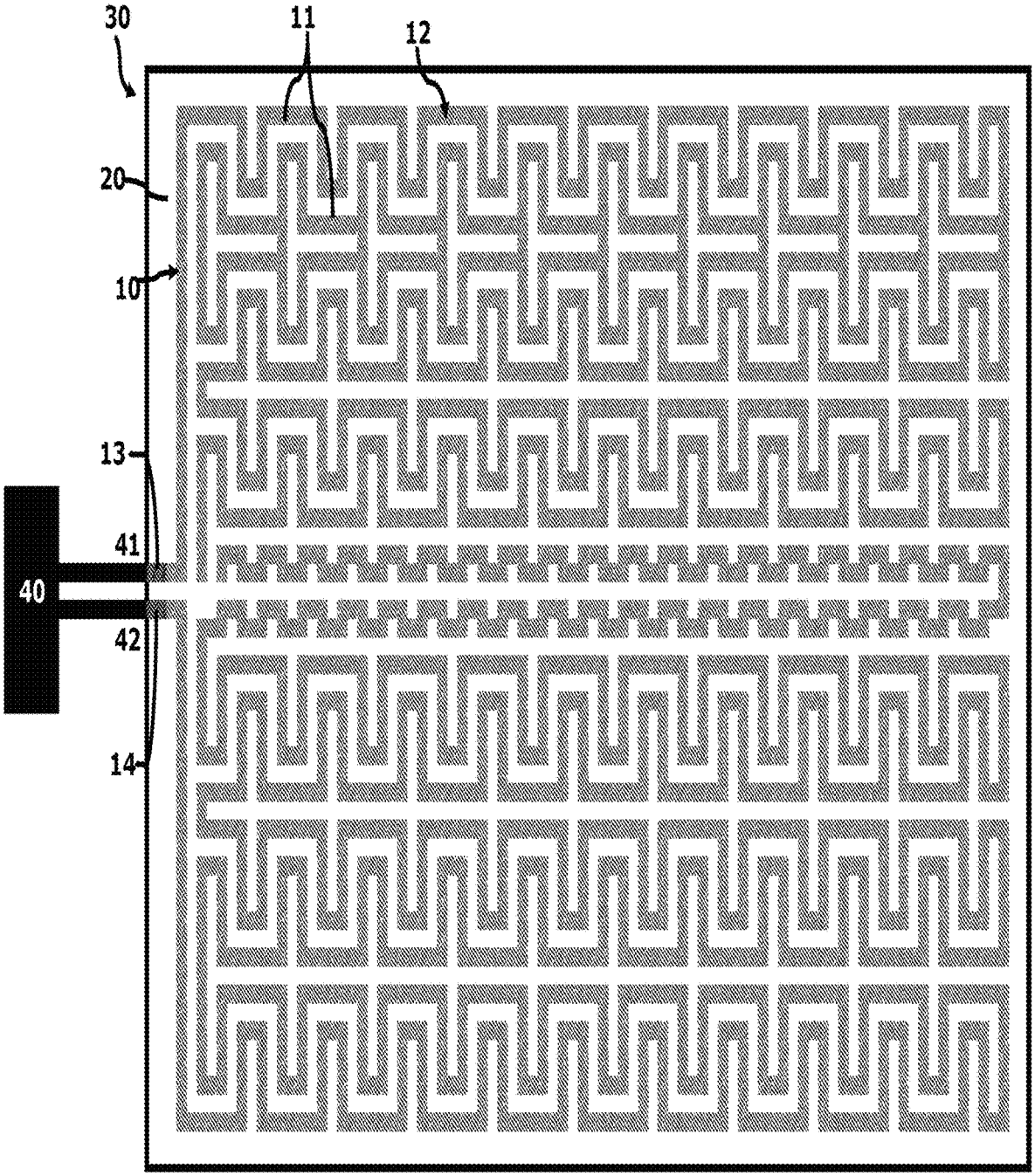
Figure 3:
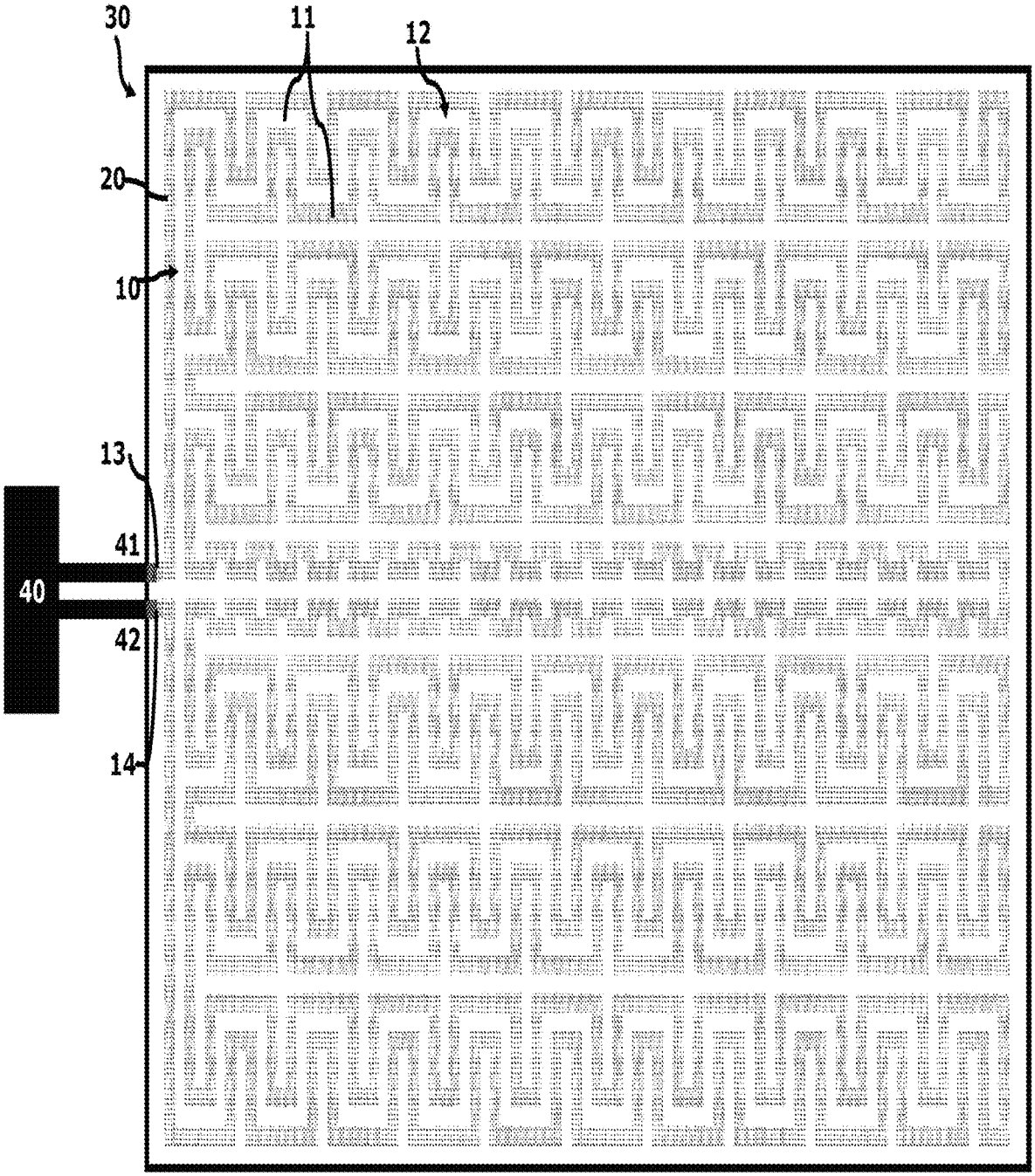
Figure 4:
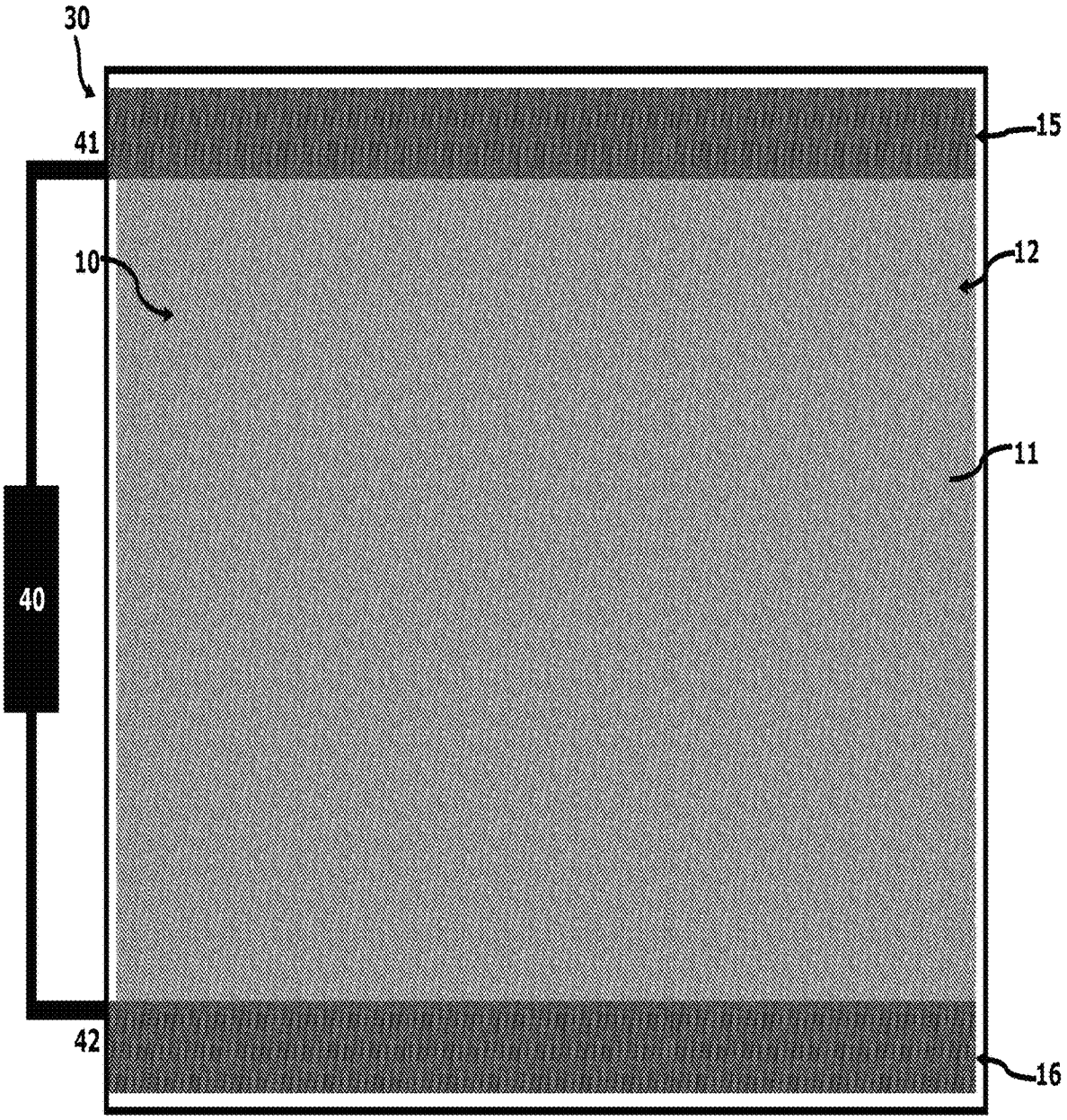
Figure 5:
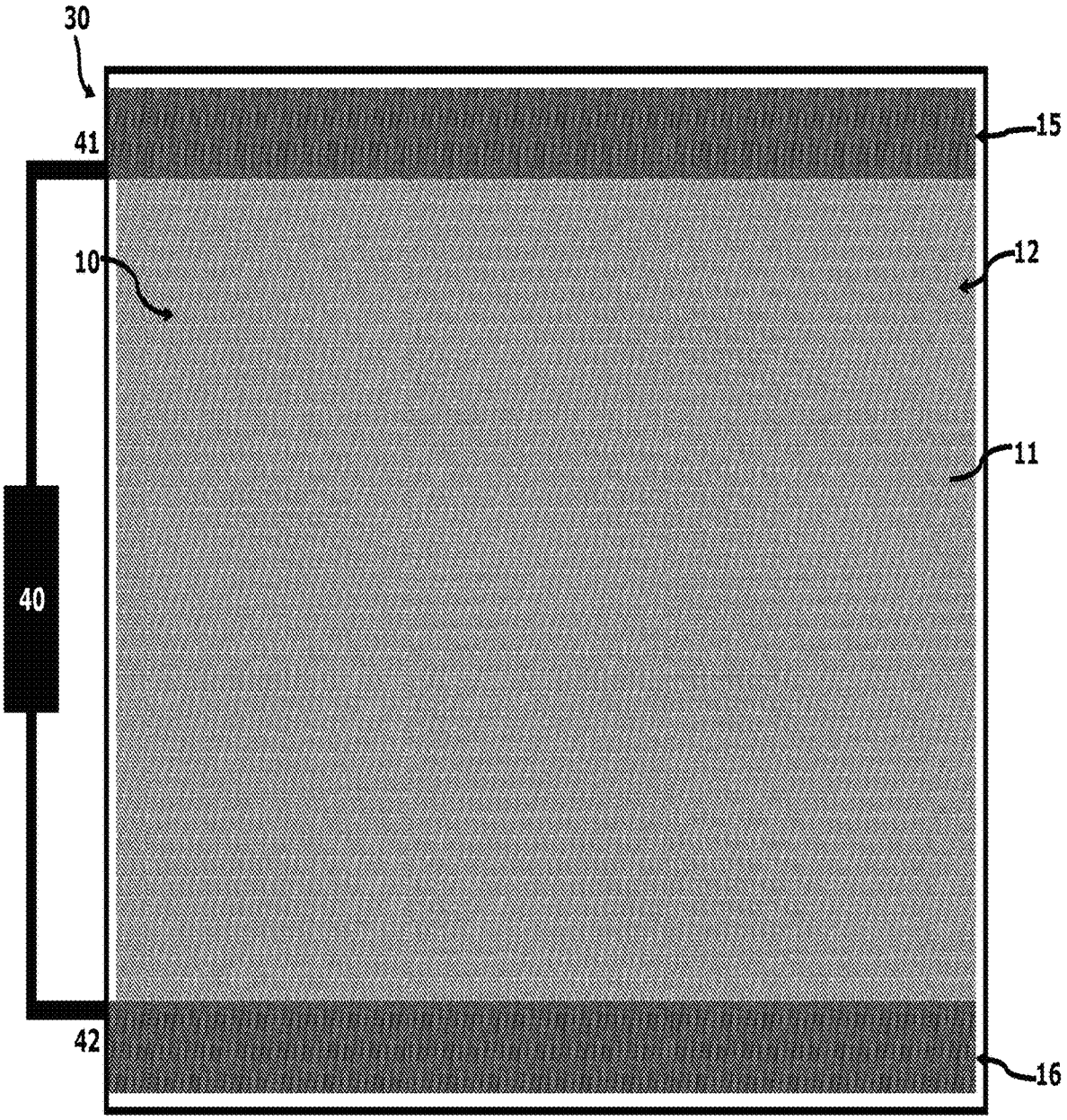
Figure 6:
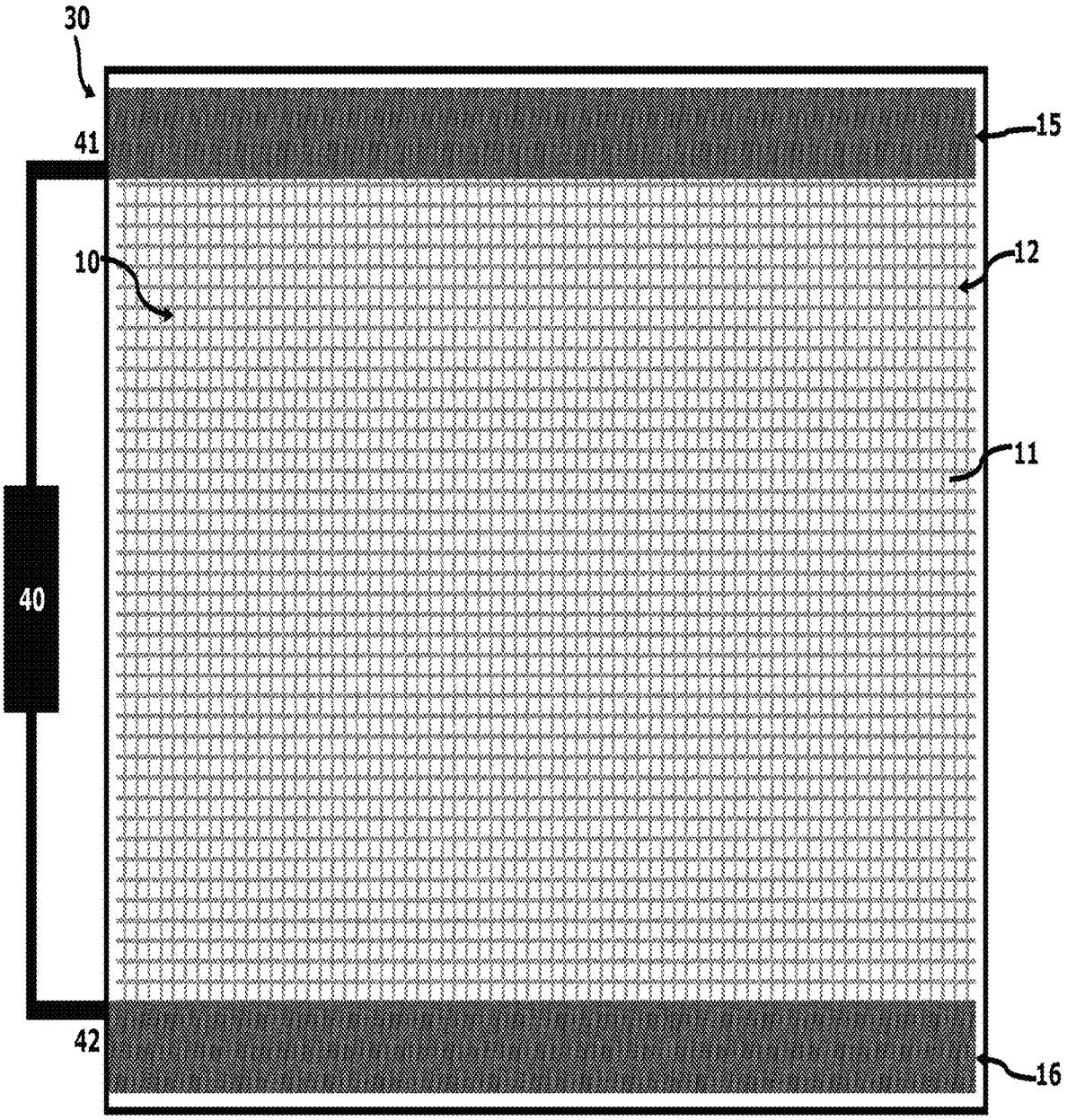
Figure 7:
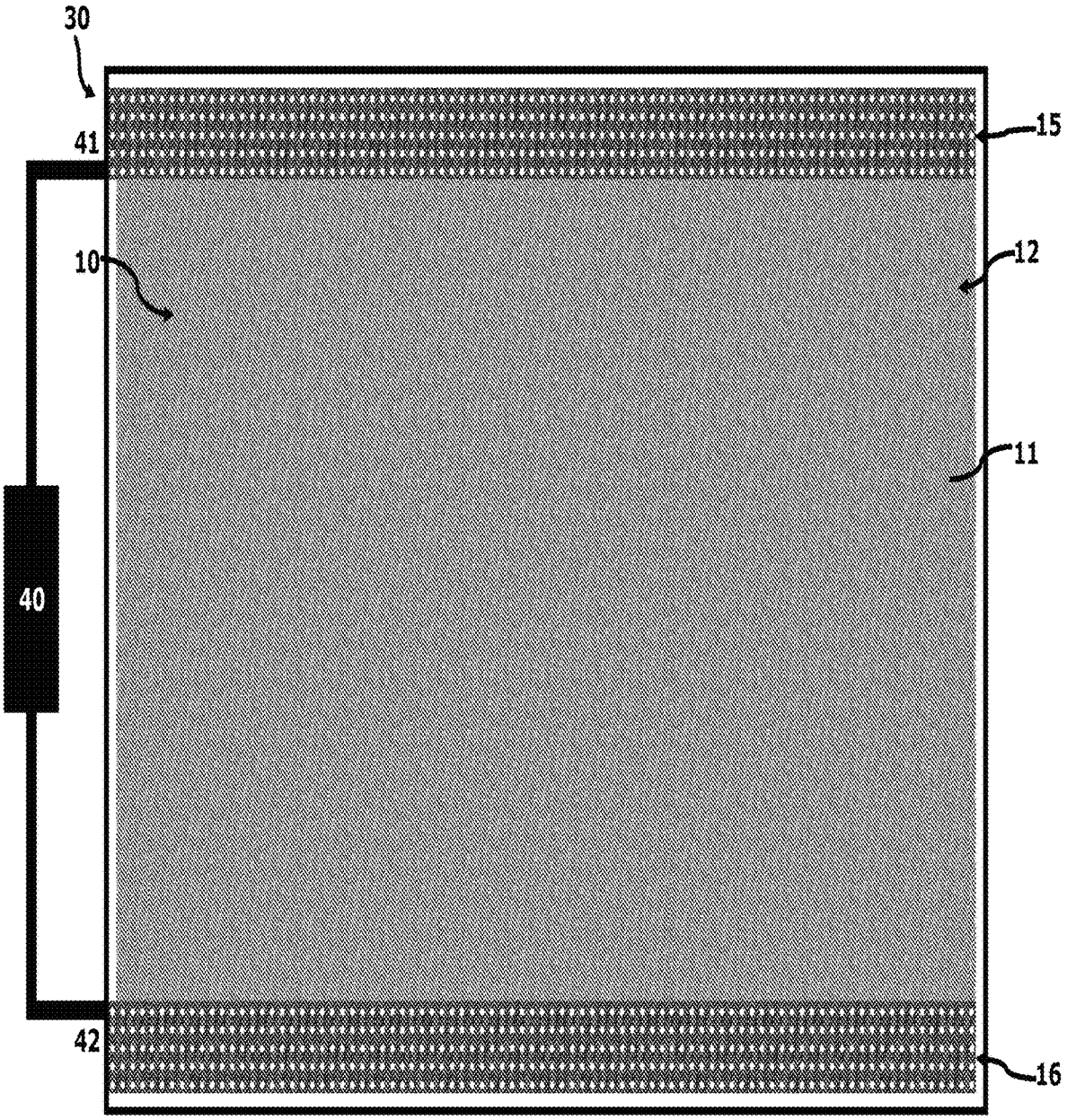
Figure 8:
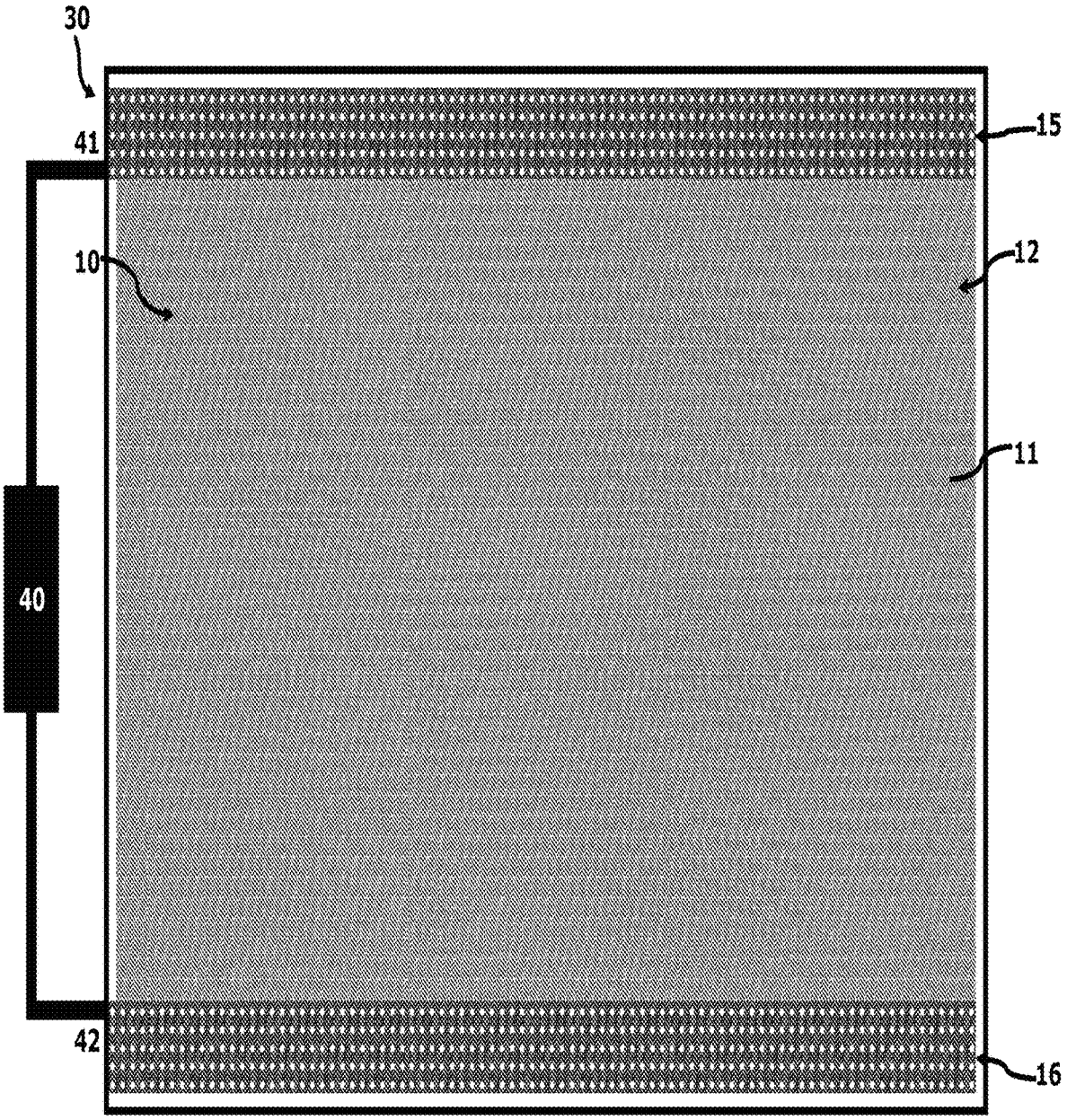
Figure 9:
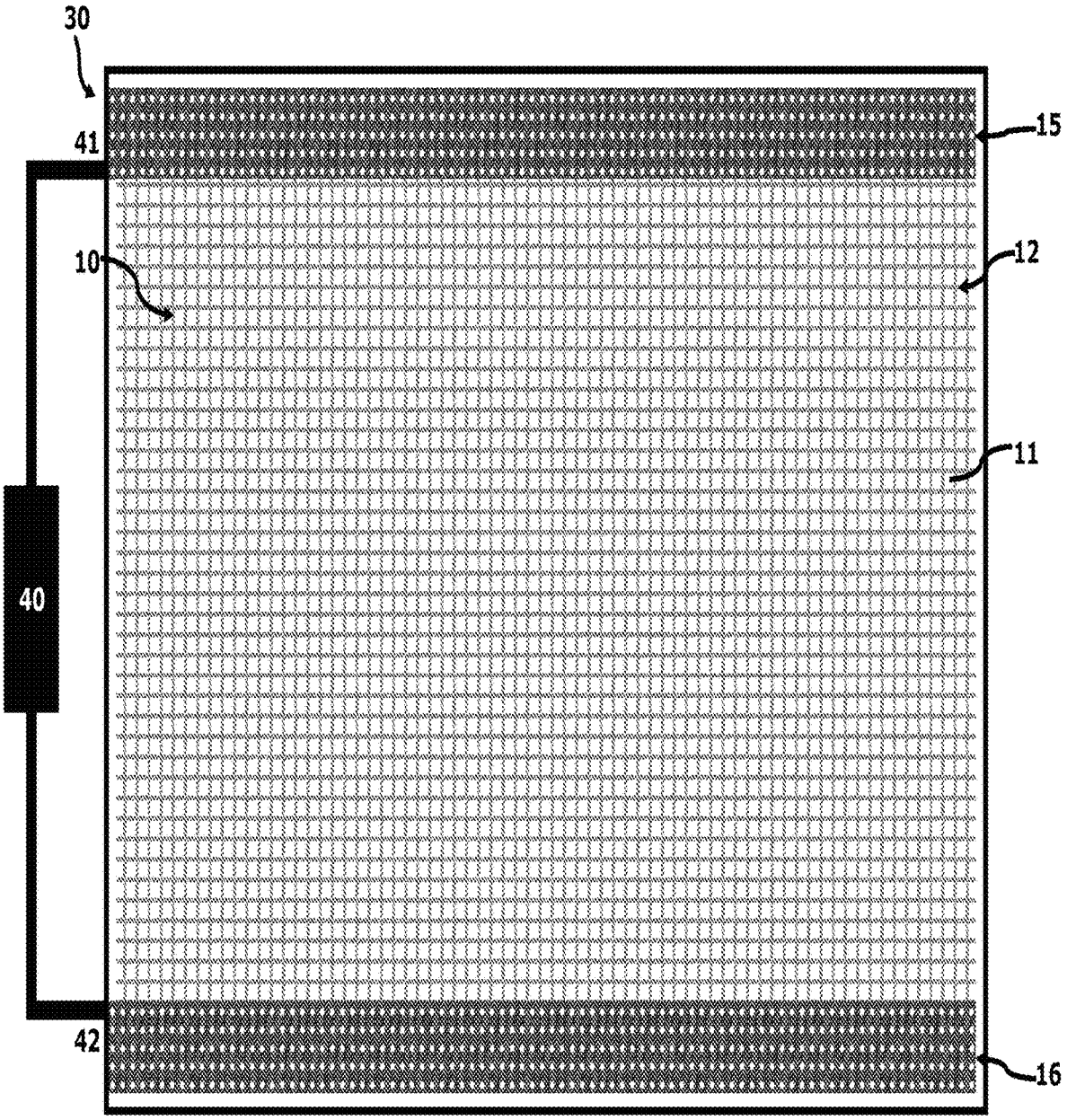

In FIGS. 1-3, a plurality of the tracks 11 produces an interconnected maze-like pattern 12 that can have bus bars 13-14 connected to the leads 41-42. The pattern 12 can be solid (FIG. 1), perforated (FIG. 2), or gridded (FIG. 3).

Figure 10:
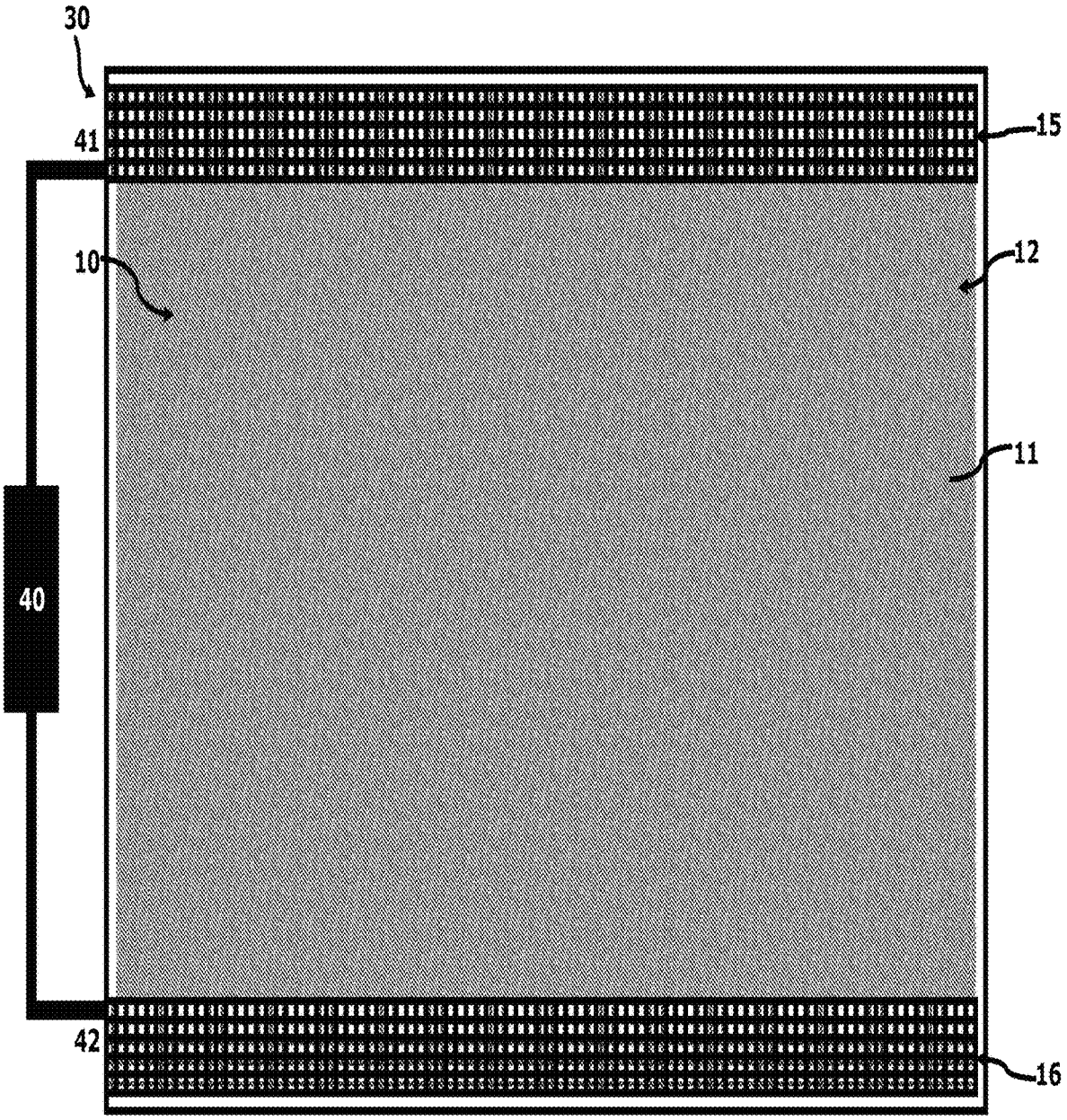
Figure 11:
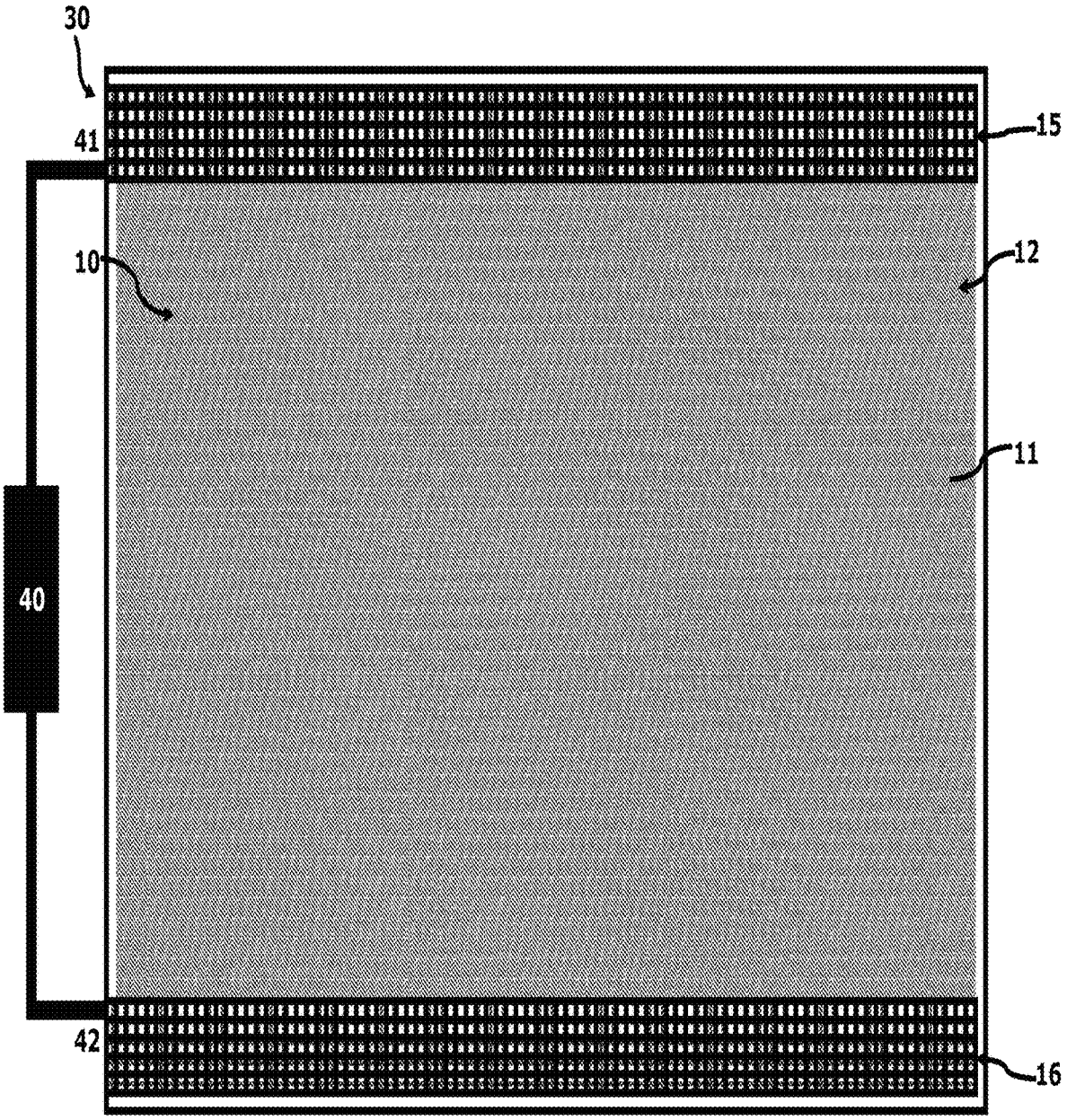
Figure 12:
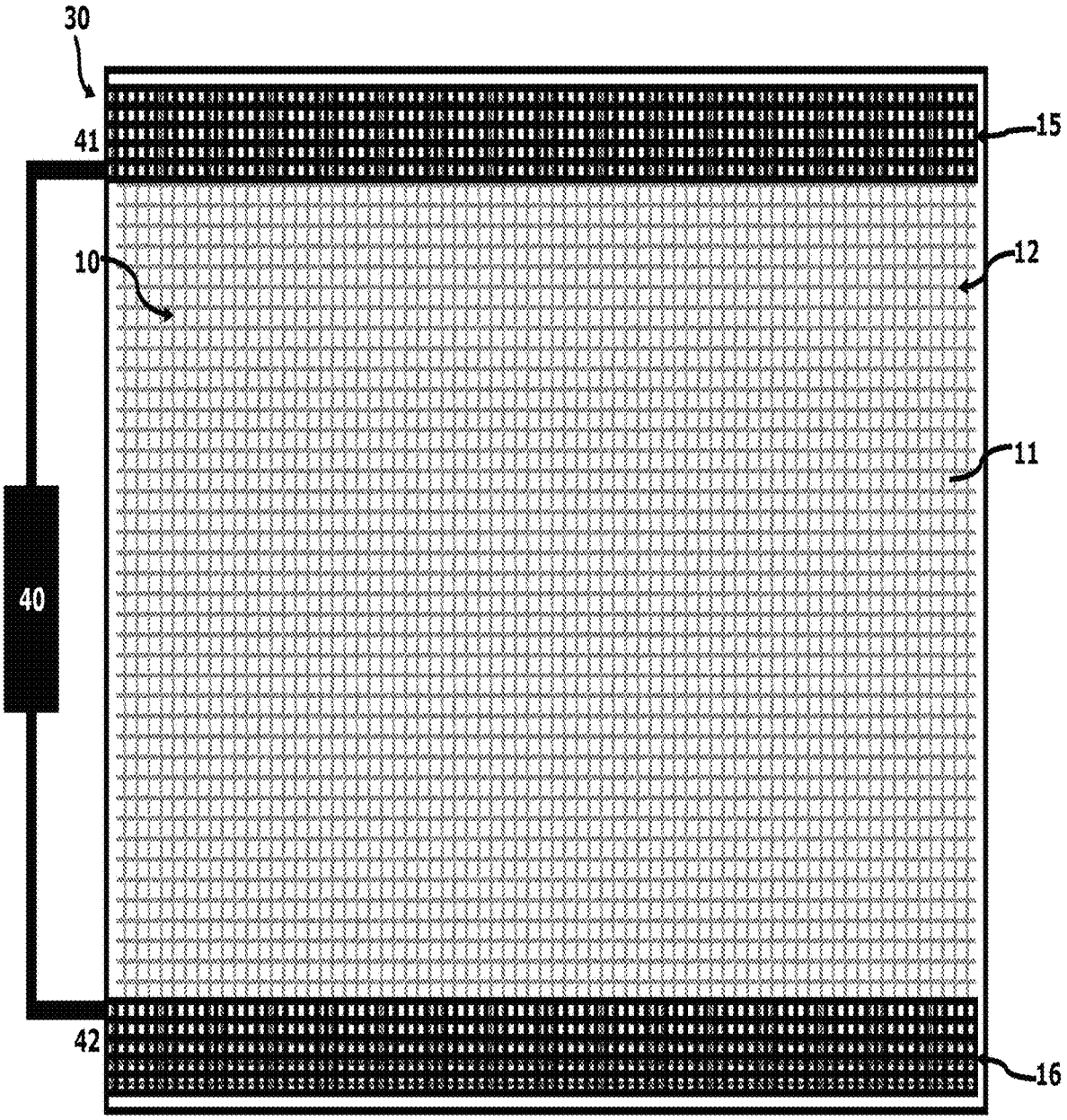
Figure 13:
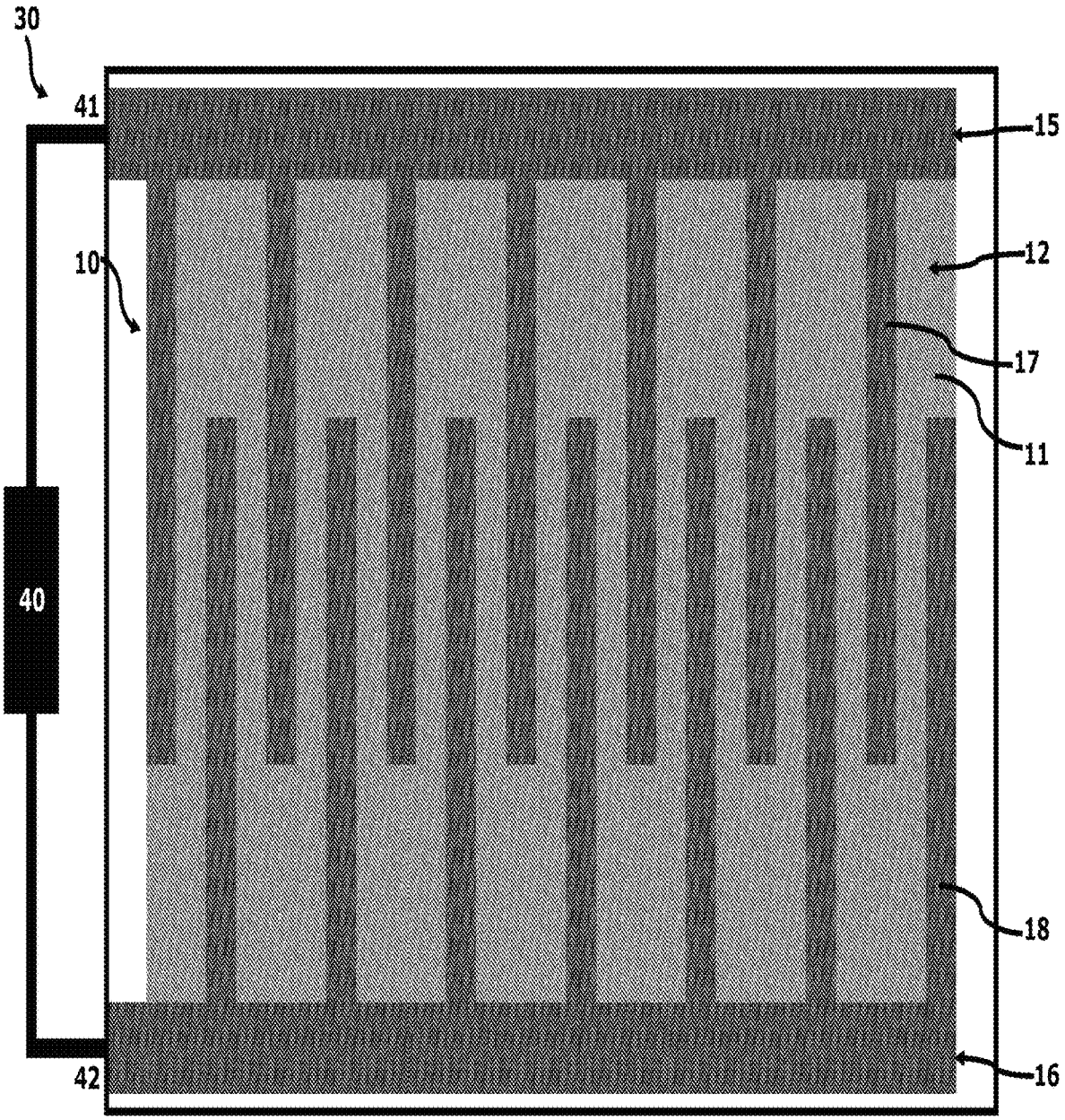
Figure 14:
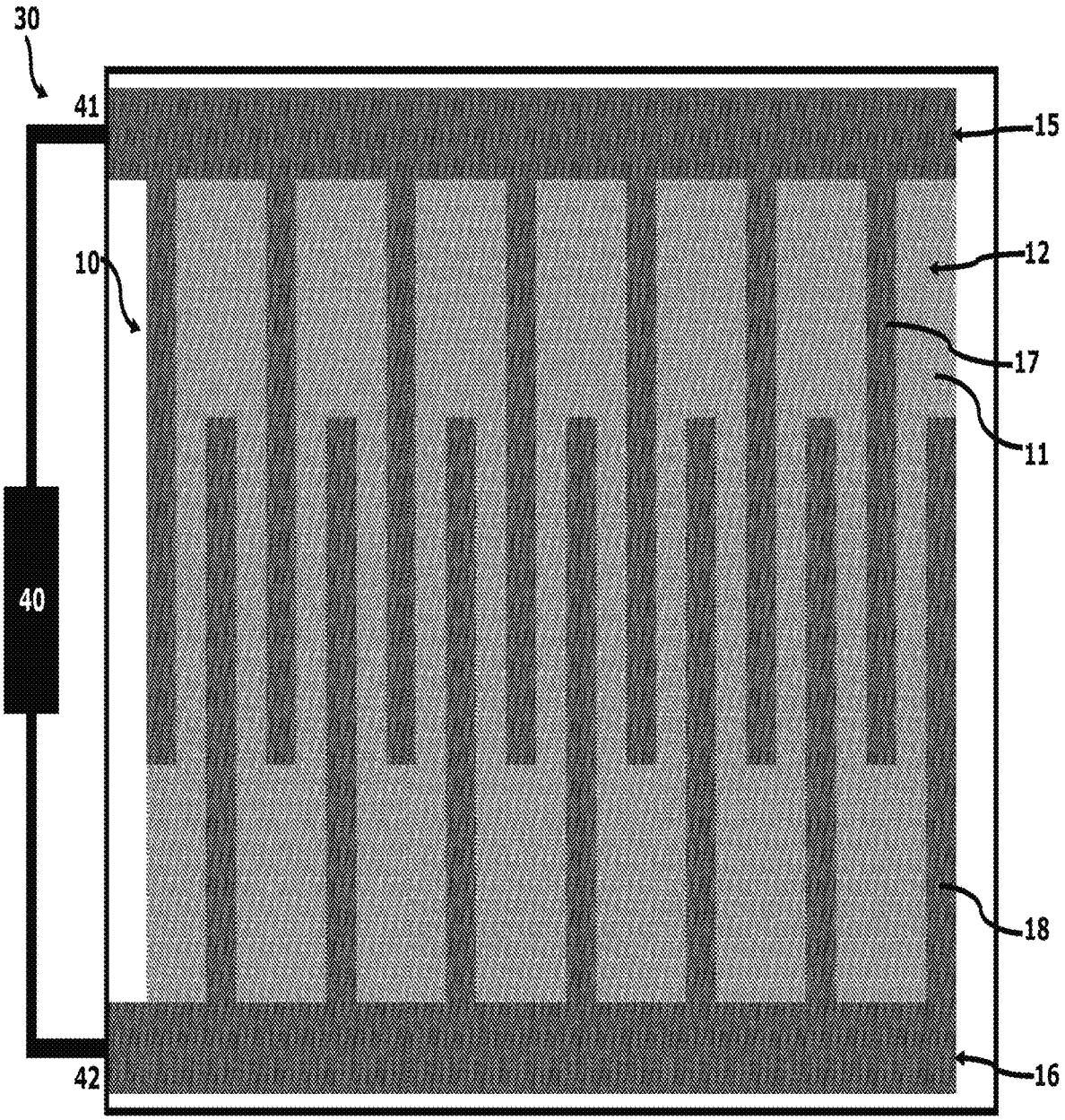

In FIGS. 4-12, a single printed track 11 forms a patch pattern 12, and the heating element 10 further comprises bus bars 15-16 electrically connected to opposite edges of the patch pattern 12 and connected to the leads 41-42. The pattern 12 can be solid (FIG. 4, FIG. 7, FIG. 10), perforated (FIG. 5, FIG. 8, FIG. 11), or gridded (FIG. 6, FIG. 9, FIG. 12) and the bus bars 15-16 can be solid (FIG. 4, FIG. 5, FIG. 6), perforated (FIG. 7, FIG. 8, FIG. 9), or gridded (FIG. 10, FIG. 11, FIG. 12).

Figure 15:
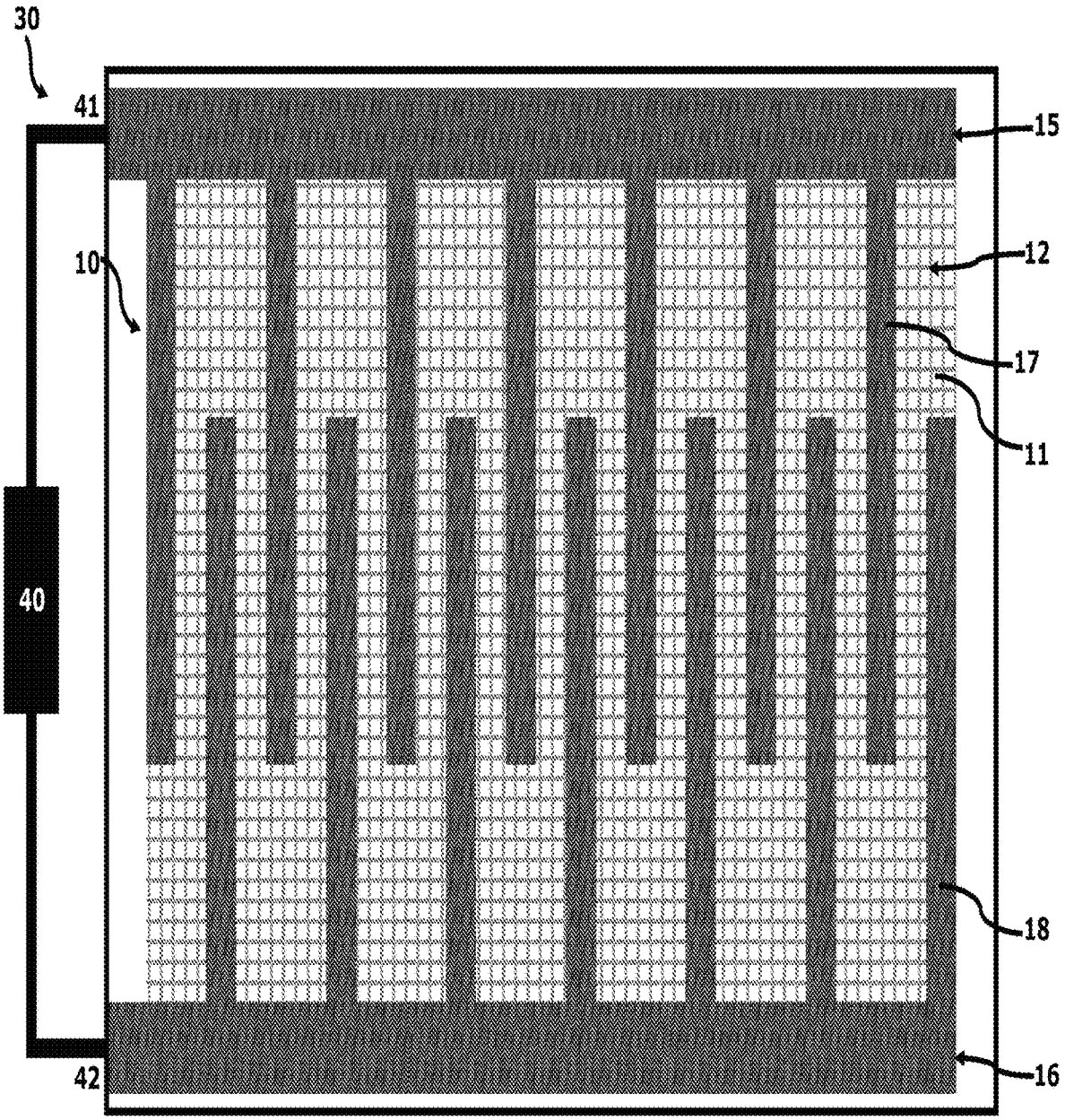
Figure 16:
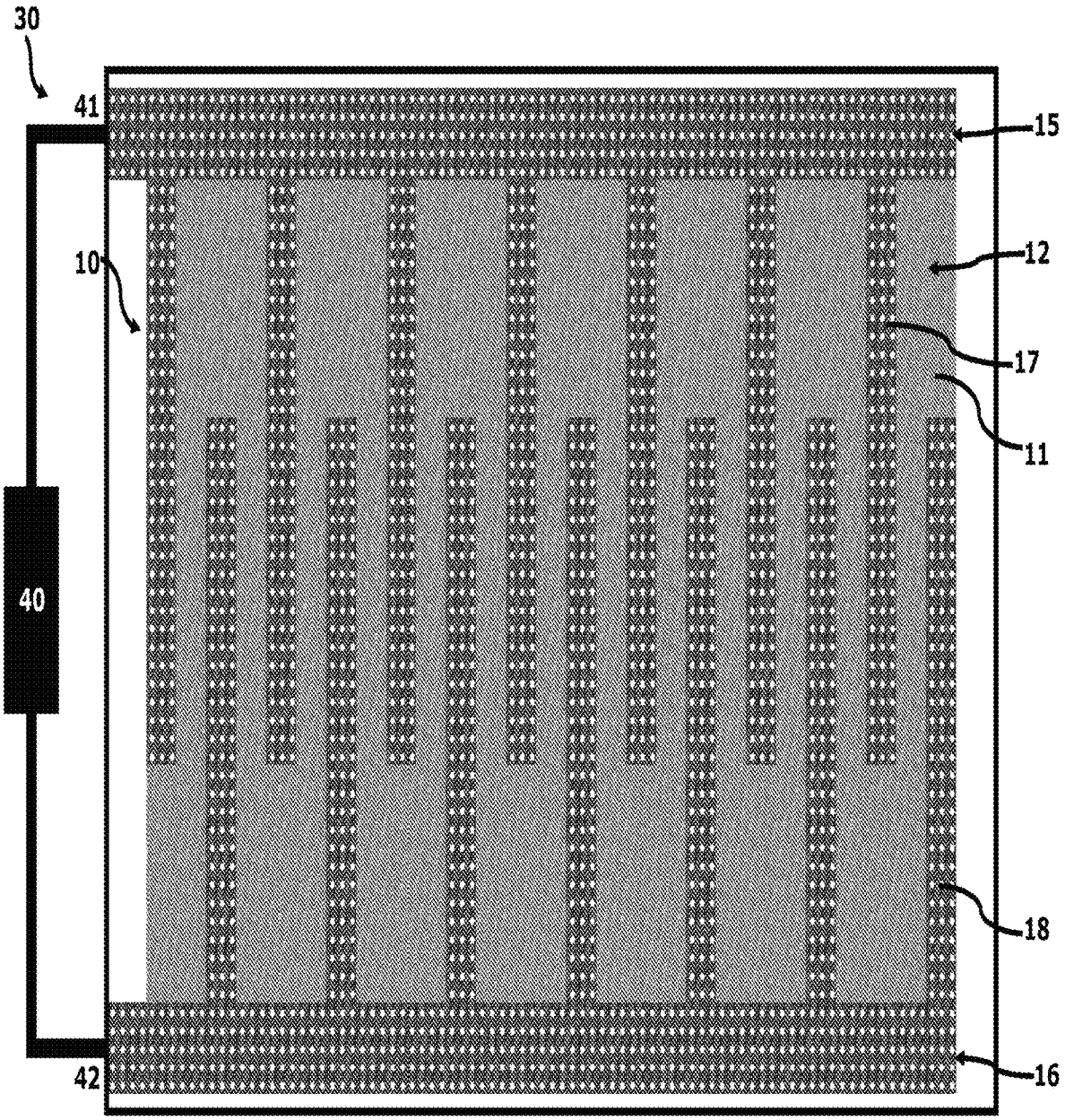
Figure 17:
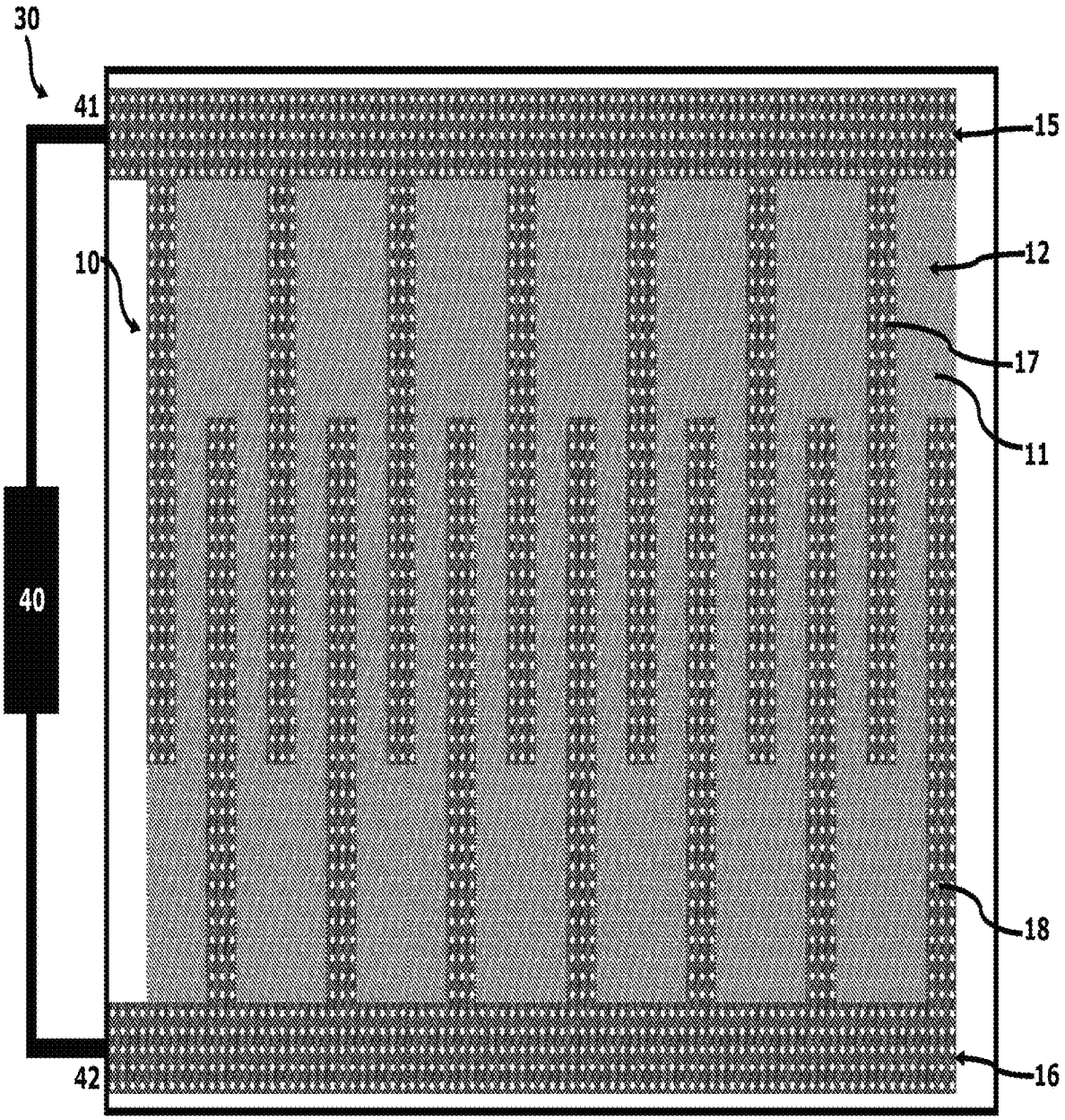
Figure 18:
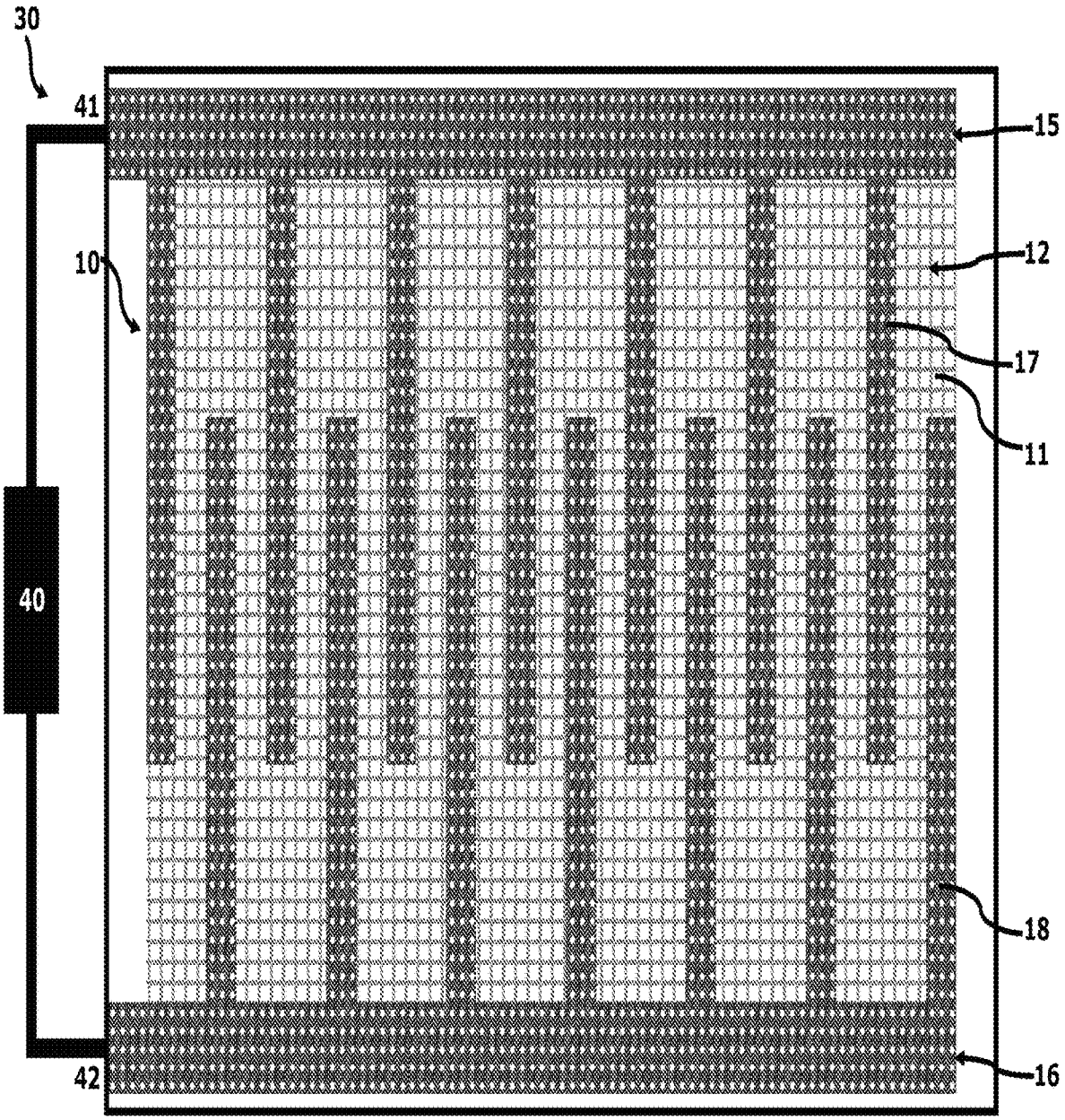
Figure 19:
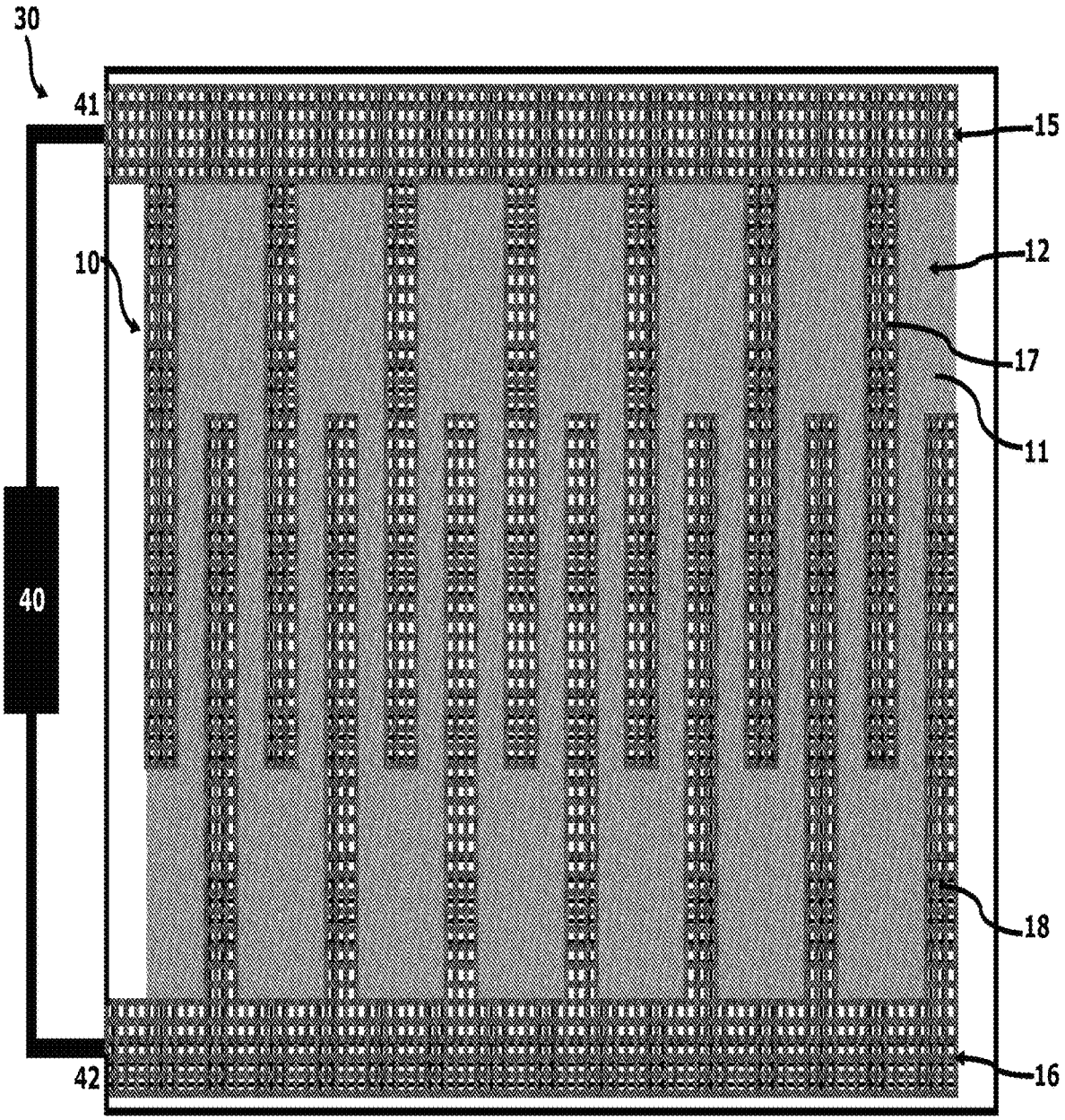
Figure 20:
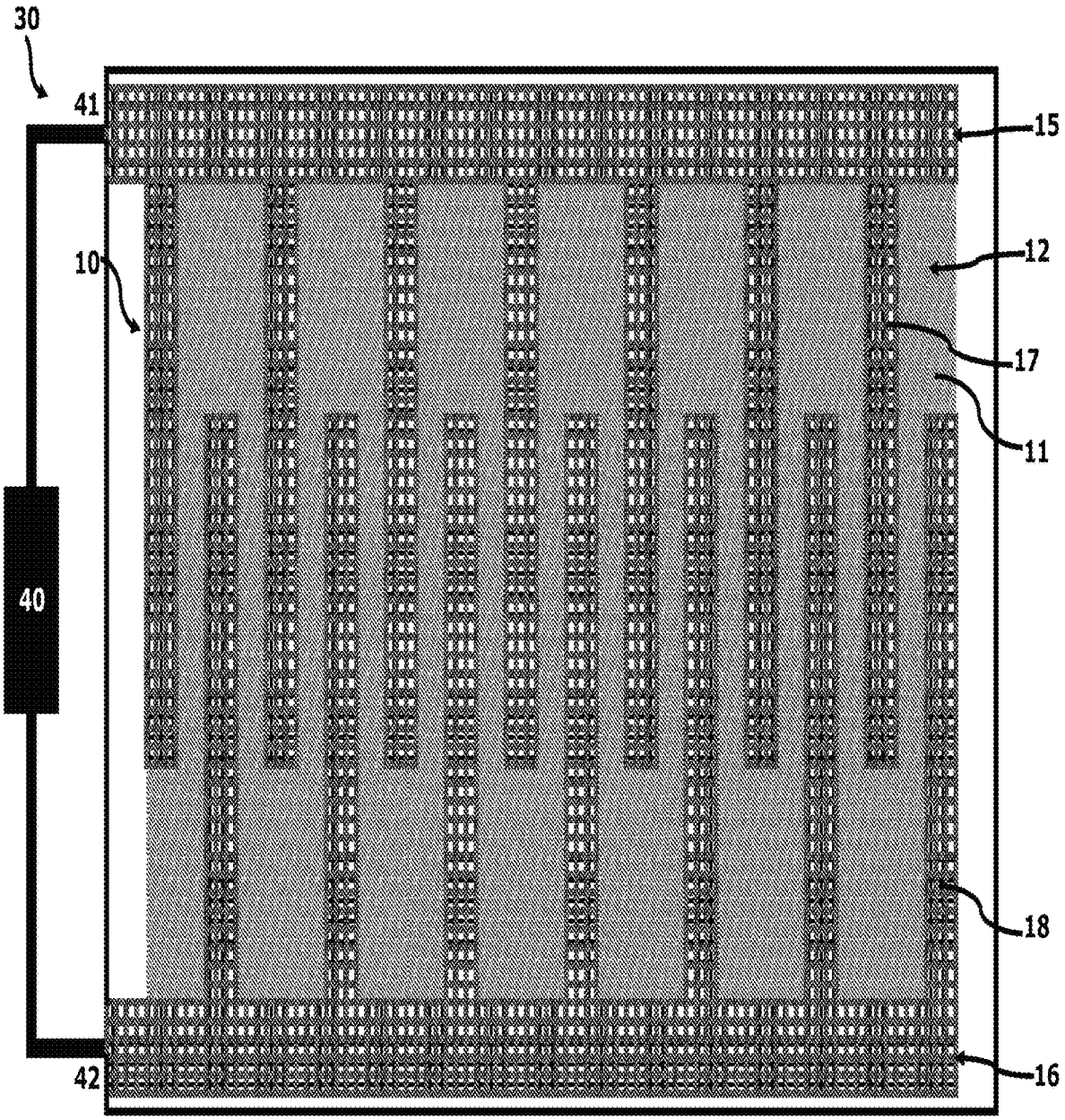
Figure 21:
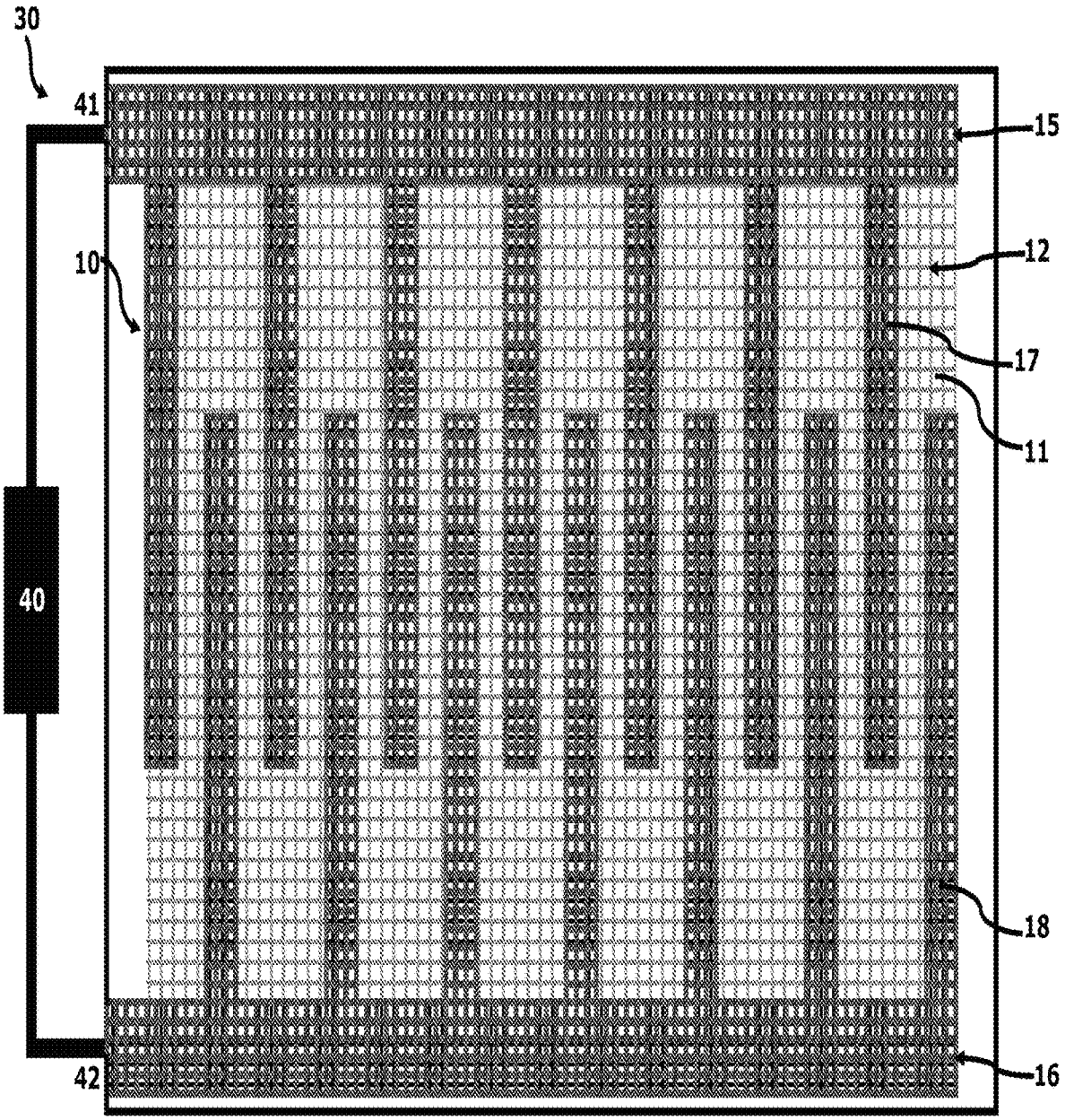
Figure 22A:
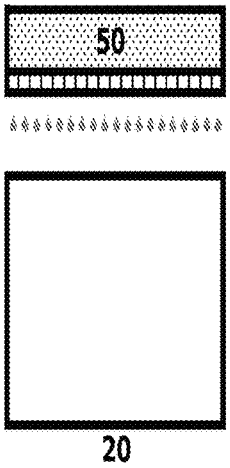
FIGS. 22A-22G show process steps for making a printed heating element according to one embodiment.
Figure 22B:
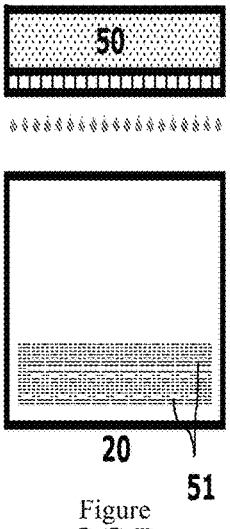
Figure 22C:
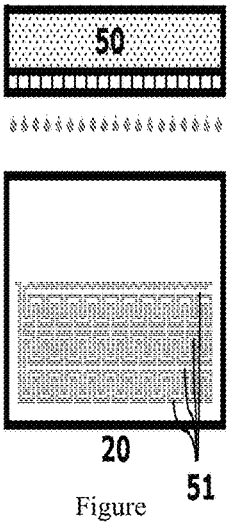
Figure 22D:
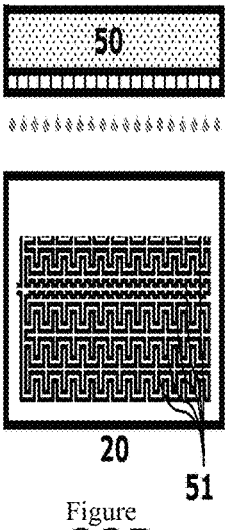
Figure 22E:
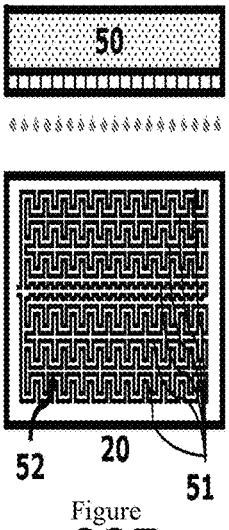
Figure 22F:
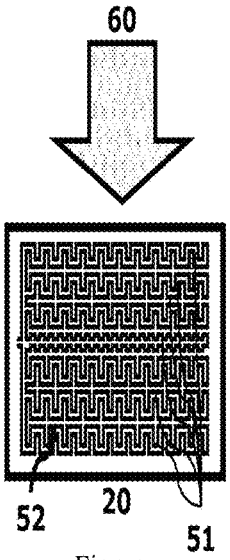
Figure 22G:
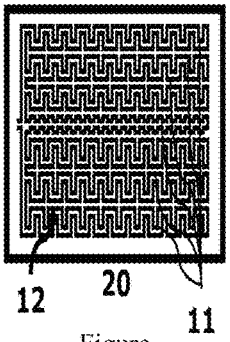
Figure 23A:
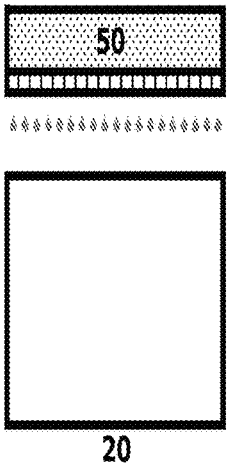
Figure 23B:
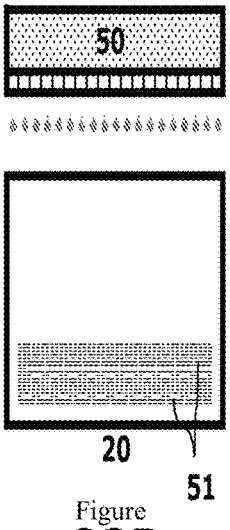
Figure 23C:
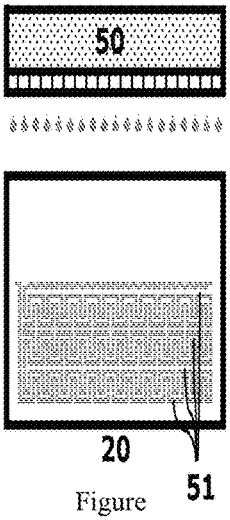
Figure 23D:
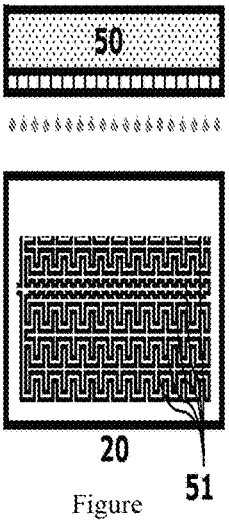
Figure 23E:
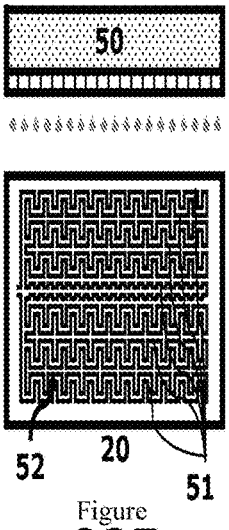
Figure 23F:
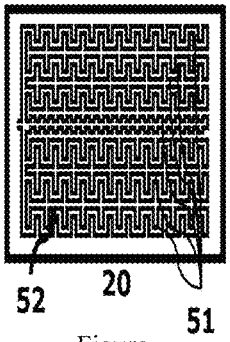
Figure 23G:
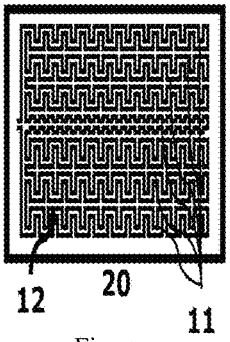

In FIGS. 13-21, the heating element 10 includes a single printed track 11, a patch pattern 12, edge bus bars 15-16, and also interior bars 17-18 projecting from the bus bars 15-16 into the pattern 12. The interior bus bars 17-18 can be narrower than the edge bus bars 15-16 and/or they can be interdigitated. Again, the pattern 12 can be solid (FIG. 13, FIG. 16, FIG. 19), perforated (FIG. 14, FIG. 17, FIG. 20) or gridded (FIG. 15, FIG. 18, FIG. 21). And the bus bars 15-18 can be solid (FIG. 13, FIG. 14, FIG. 15), perforated (FIG. 16, FIG. 17, FIG. 18), or gridded (FIG. 19, FIG. 20, FIG. 21).

In the heating-element embodiments with perforated tracks 11 and/or perforated bus bars 15-18 (FIG. 2, FIG. 5, FIGS. 7-9, FIG. 11, FIG. 14, FIGS. 16-18, FIG. 20), the size, shape, and spacing of the perforations can be varied to achieve the desired resistance, including making sure that the bus bars 15-18 are less resistant (and thus less heat-producing) than the tracks 11. The same is true with the heating-element embodiments having gridded tracks 11 and/or gridded bus bars 15-18 (FIG. 3, FIG. 6, FIGS. 9-12, FIG. 15, FIGS. 18-21).

Referring to FIGS. 22A-23G, the heating element 10 shown in FIGS. 1-3 can be made by printing an ink solution 50 onto a substrate (e.g., the substrate 20). The printing steps are performed to produce printed trails 51 forming an interconnected maze-like pattern 52 corresponding to the pattern 12 (FIGS. 22A-22E). As shown in FIG. 22A-22G, the trails 51 can then be subjected to post-print curing 60 (FIG. 22F) to produce the pattern 12 of electrically conductive tracks 11 (FIG. 22G). Or as shown in FIGS. 23A-23G, a post-print curing step may not be necessary with some ink solutions 50 as it may just need to dry or it may dry immediately upon printing.

Figure 25A:
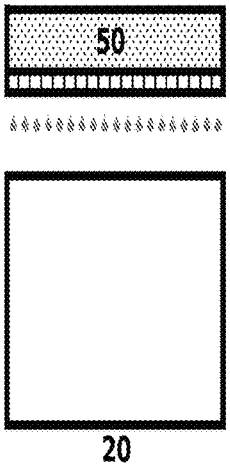
Figure 25B:
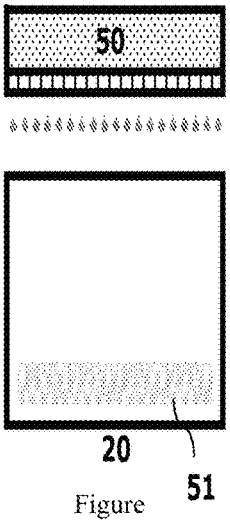
Figure 25C:
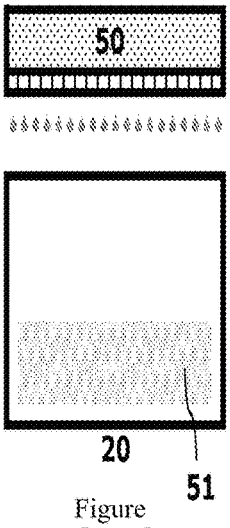
Figure 25D:
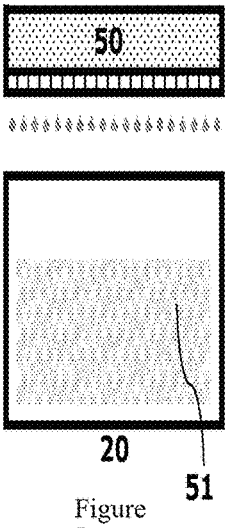
Figure 25E:
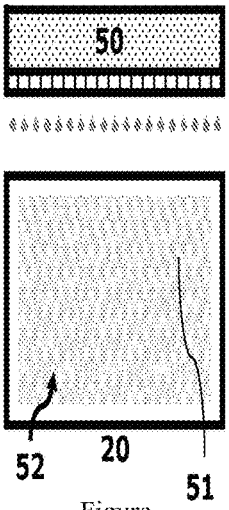
Figure 25F:
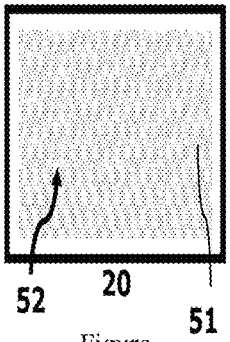
Figure 25G:
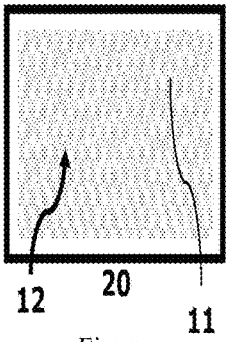
Figure 25H:
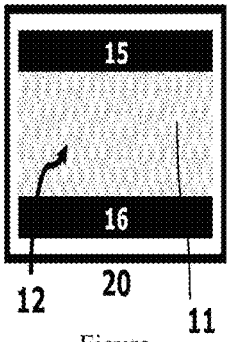
Figures 27A, 27B, 27C, 27D, 27E:
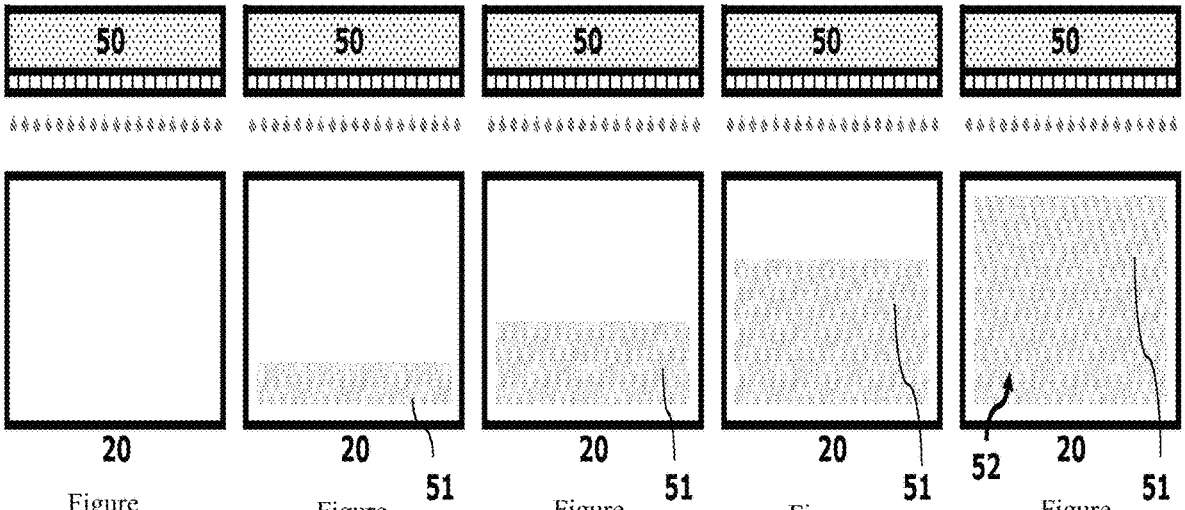
Figures 27F, 27G, 27H, 27I, 27J:
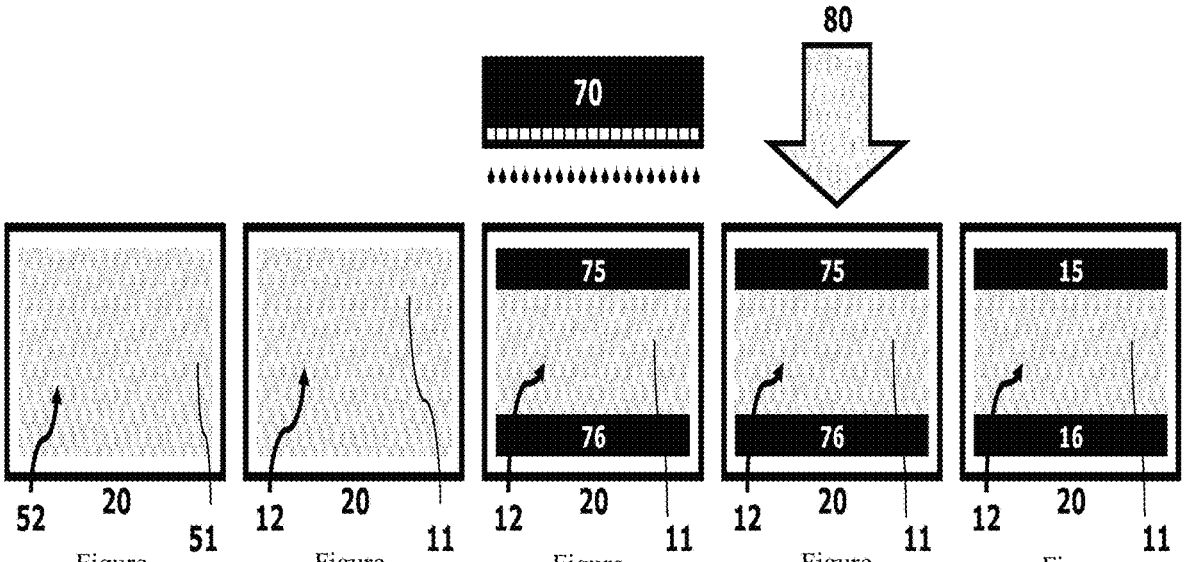
Figures 29A, 29B, 29C, 29D, 29E:
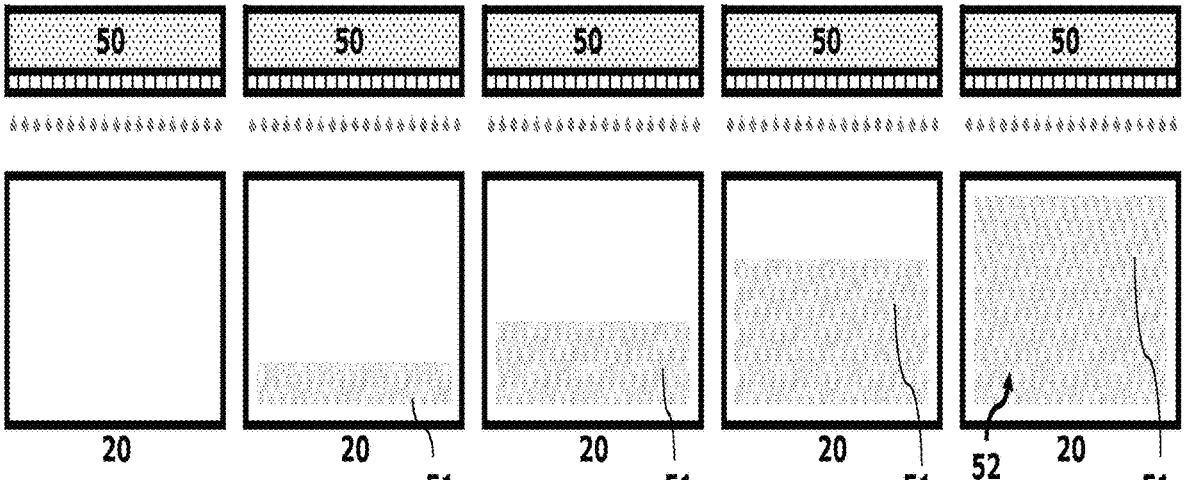
Figures 29F, 29G, 29H, 29I, 29J:
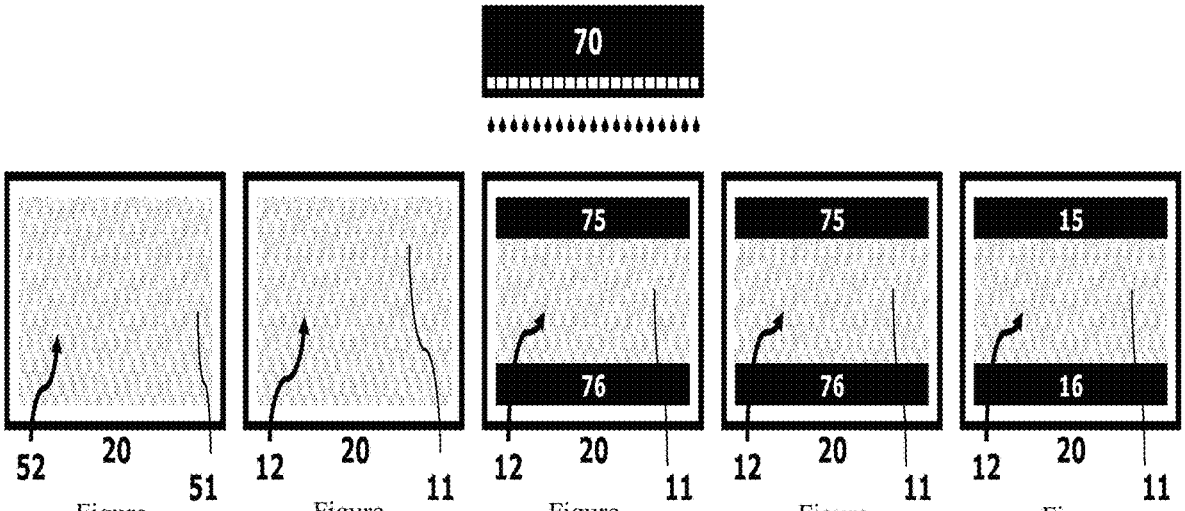
Figures 30A, 30B, 30C, 30D, 30E:
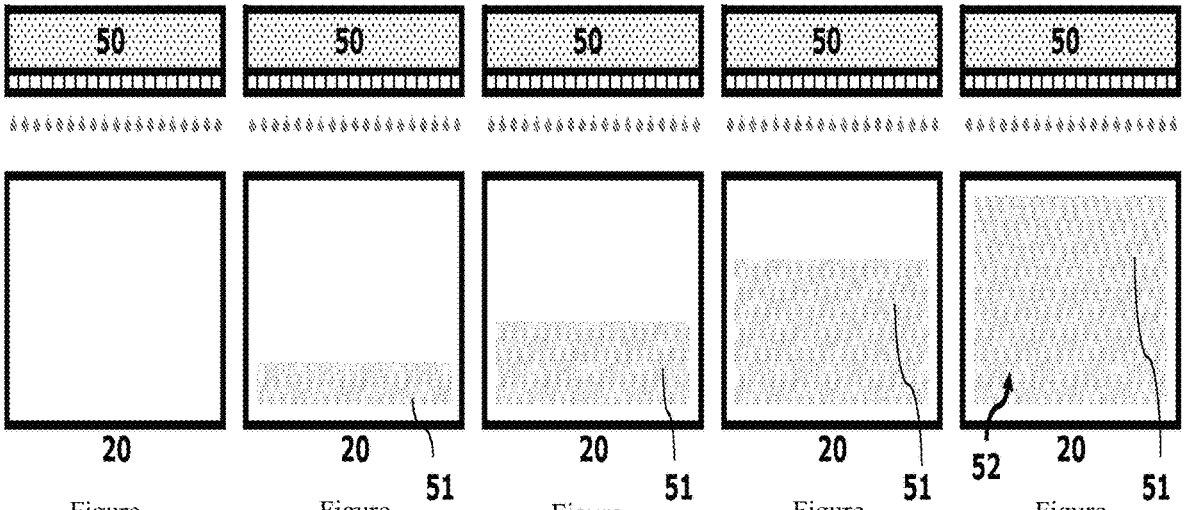
Figures 30F, 30G, 30H:
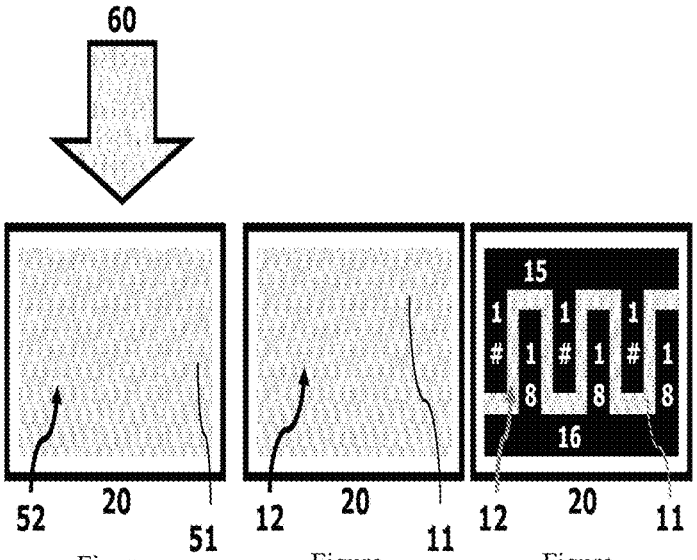
Figure 31A:
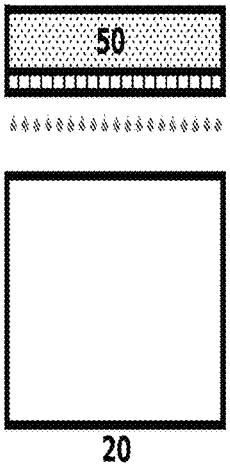
Figure 31B:
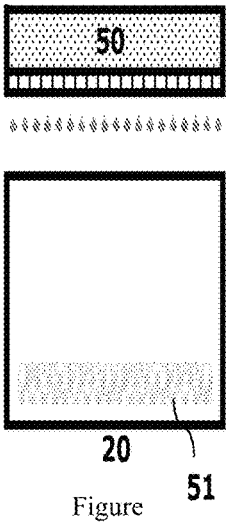
Figure 31C:
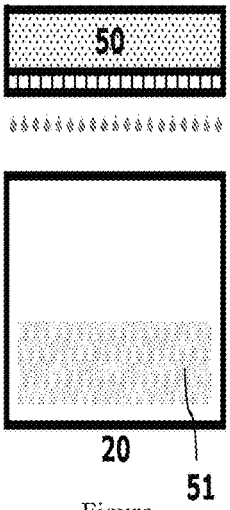
Figure 31D:
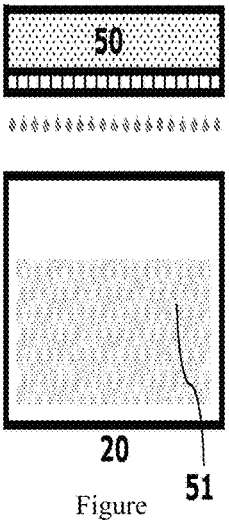
Figure 31E:
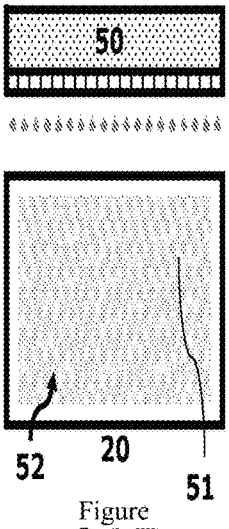
Figure 31F:
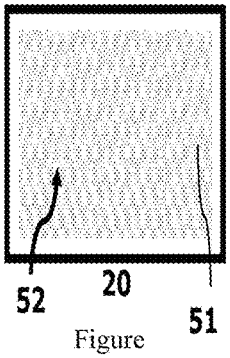
Figure 31G:
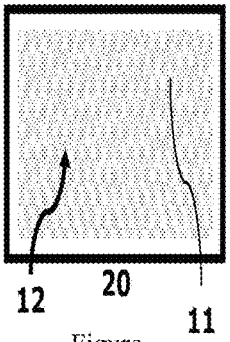
Figure 31H:
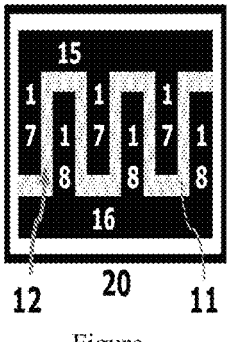
Figures 32A, 32B, 32C, 32D, 32E, 32F, 32G, 32H, 32I, 32J:
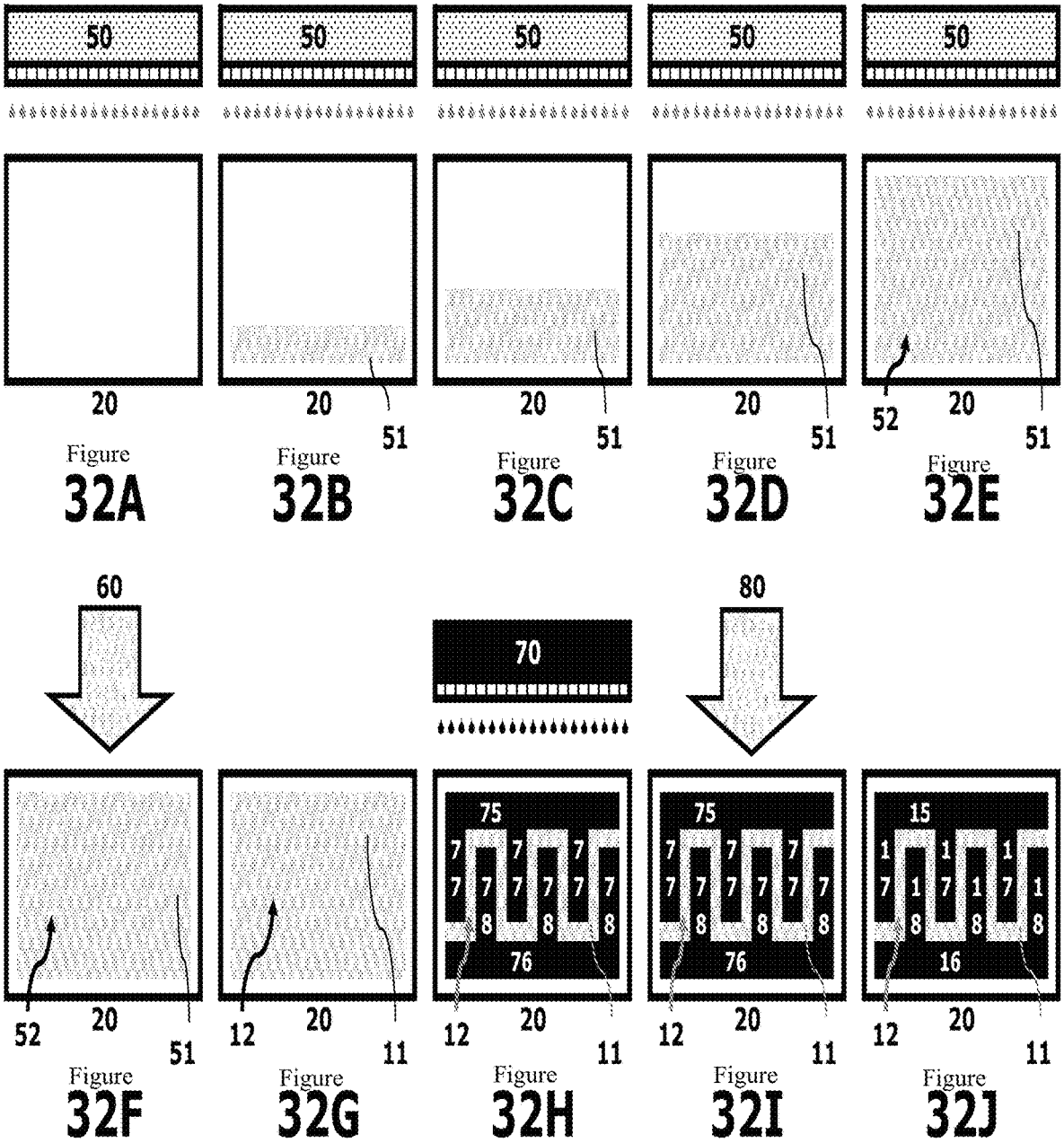
Figures 33A, 33B, 33C, 33D, 33E:
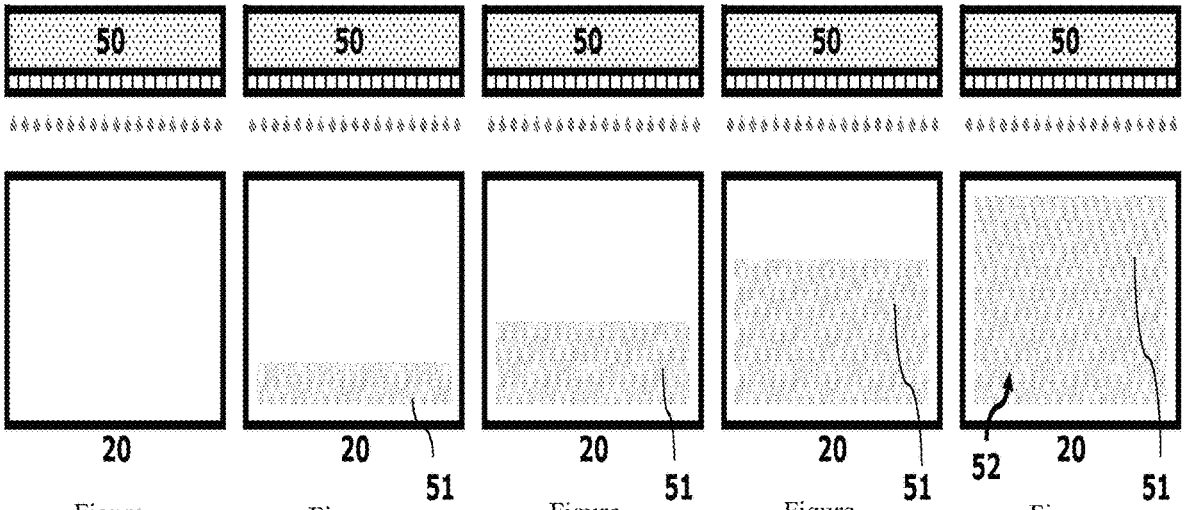
Figures 33F, 33G, 33H, 33I, 33J:
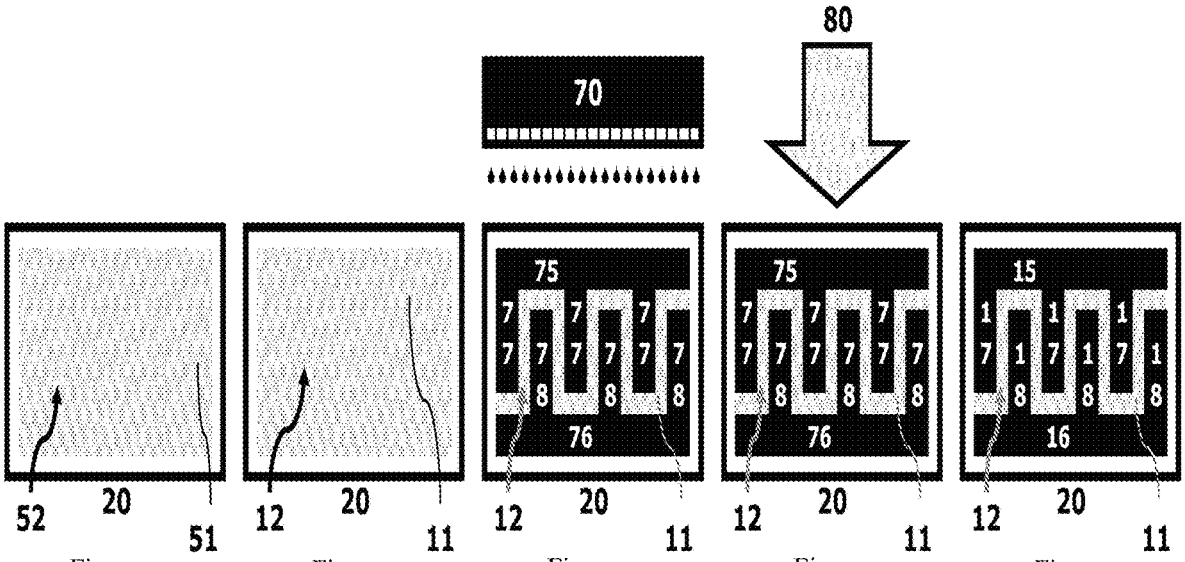
Figures 34A, 34B, 34C, 34D, 34E:
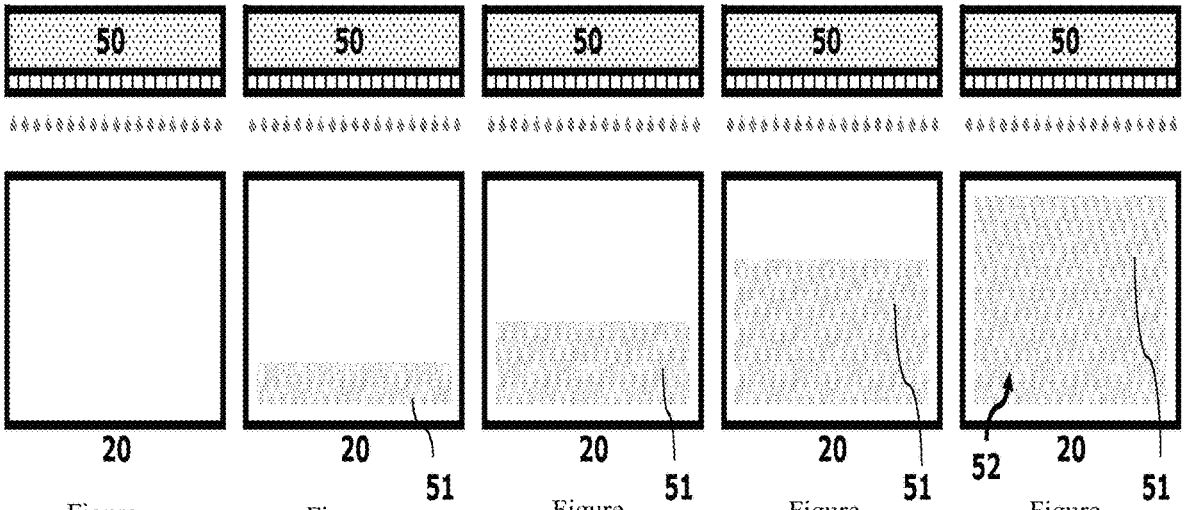
Figures 34F, 34G, 34H, 34I, 34J:
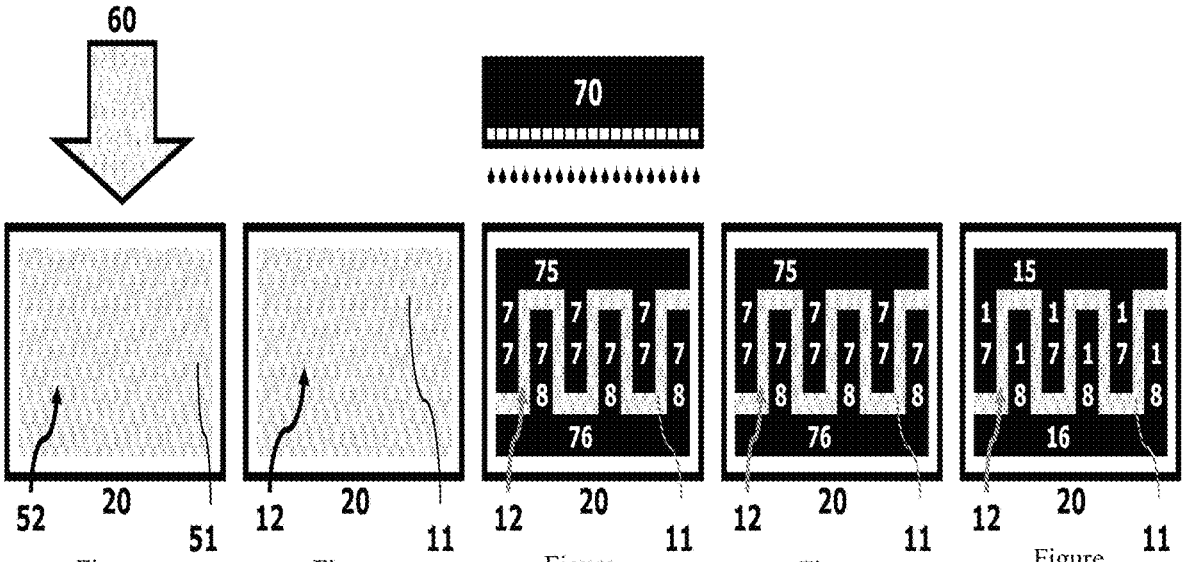
Figure 35A:
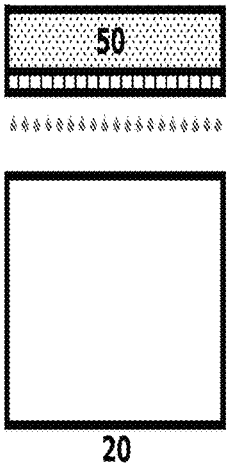
Figure 35B:
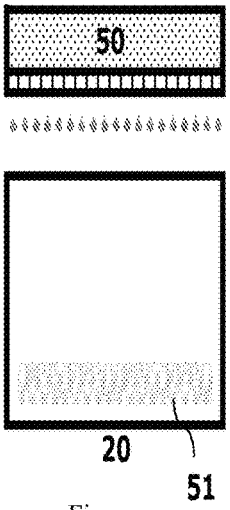
Figure 35C:
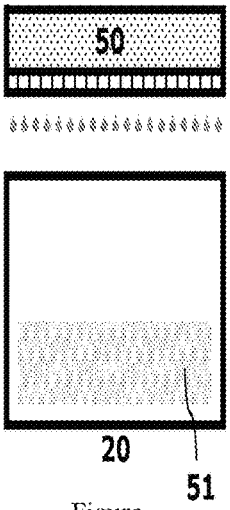
Figure 35D:
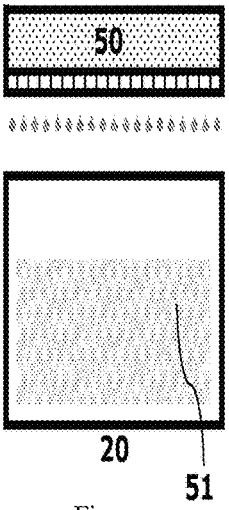
Figure 35E:
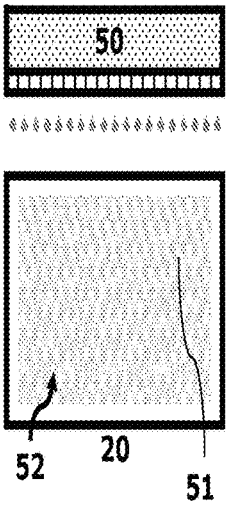
Figure 35F:
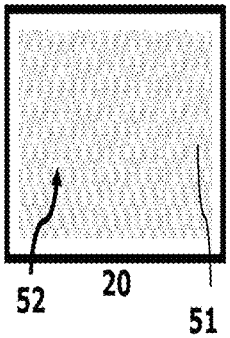
Figure 35G:
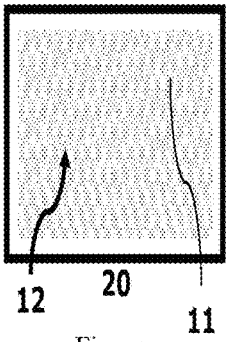
Figure 35H:
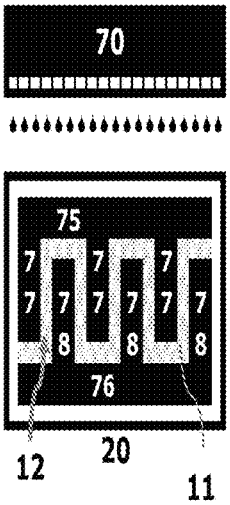
Figure 35I:
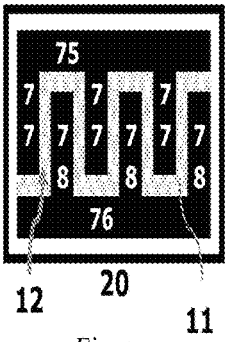
Figure 35J:
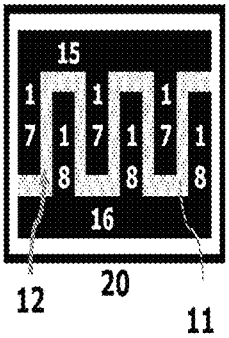

Referring to FIGS. 24A-25H, the heating element 10 shown in FIGS. 4-12 can be made by printing an ink solution 50 onto a substrate (e.g., the substrate 20) to produce a single printed trail 51 forming a patch pattern 52 (FIGS. 24A-24E, FIGS. 25A-25E). The trail 51 can then be subjected to post-print curing 60 (FIG. 24F) or not (FIG. 25F) to produce a single track 11 in a solid patch pattern 12 (FIG. 24G, FIG. 25G). The bus bars 15-16 can then be assembled without printing along the edges of the patch 12 (FIG. 24H or FIG. 25H). In other words, for example, they can be bulk metal or bulk metal alloy pieces placed onto the substrate 20.

Referring to FIGS. 26A-29J, the heating element 10 shown in FIGS. 4-12 can alternatively be made by printing both the pattern 12 and the bus bars 15-16. After the pattern 12 is printed, the bus bars 15-16 can be made by printing an ink solution 70 along the edges of the patch pattern 12 to produce ingots 75-76 (FIGS. 26H-29H). The ingots 75-76 can then be subjected to post-print curing step 80 (FIGS. 26I-27I) or not (FIGS. 28I-29I) to form the bus bars 15-16 (FIGS. 26J-29J).

Referring to FIGS. 30A-35J, the heating element shown in FIGS. 13-21 can be made in much the same manner as the heating element shown in FIGS. 4-12, by printing just the pattern 12 (FIGS. 30A-32J) or by printing both the pattern 12 and the bus bars 15-18 (FIGS. 33A-35J).

The printing steps are performed in a mask-free manner and/or without substrate-contacting dispensing equipment. Possible printers include thermal inkjet printers (e.g., Lexmark etc.), piezoelectric inkjet printers (e.g., Fuki, Dimatix, Epson, Microfab, etc.), aerosol printers (e.g., Optomec), and/or Ultrasonic printers (e.g., SonoPlot). While drop-on-demand dispensing will often prove most economical, continuous dispensing systems are also feasible.

The post-print curing step 60 and/or the post-printing curing step 80 can involve fusing, sintering, decomposing, and/or firing. The step 60 and/or the step 80 can additionally or alternatively comprise drying, evaporating, or otherwise dismissing substances which are not electrically conductive. The curing steps can instead or further include exposure to radiation (e.g., ultraviolet, pulse light, laser, plasma, microwave etc.), electrical power, or chemical agents.

Post-print curing steps 60/80 can be accomplished at room temperature (e.g., 20° C. to 25° C.) if they involves only simple evaporation of solvent or radiation or electrical power or chemical agent. With thermal curing procedures, it can be accomplished at elevated temperatures (e.g., 50° C. to 400° C., and/or 100° C. to 150° C.). Low-temperature curing conditions can accommodate a substrate (e.g., a plastic substrate) unable to withstand elevated temperature. Post-print curing can also be accomplished with a combination of thermal, radiation, electrical power and/or chemical agent treatments.

The ink solution 50 and/or the ink solution 70 can comprise a particle-free ink solution wherein a metal compound is dissolved in a solvent or solvents. One example of a particle-free ink solution can be made with an organ metallic platinum ink developed by Ceimig Limited in the United Kingdom. The platinum ink is mixed with a solvent (e.g., toluene, cyclopentanone, cyclohexanol, etc.) and a viscosity modifier (e.g., a nisole, terpineol). With the Ceimig ink solution, the post-printing curing step 60/80 can be performed at elevated temperatures (e.g., 300° C. or more) for relatively short time periods (less than 3 minutes).

Another example of a particle-free ink solution is the particle-free silver ink developed by the University of Illinois. This silver ink is a transparent solution of silver acetate and ammonia wherein the silver remains dissolved in the solution until it is printed and the liquid evaporates. In this case, post-print curing steps 60/80 can involve heating to decompose the component to release the silver atoms to form the conductive path.

A further example of a particle-free ink solution is the silver ink sold by the Gwent Group under product number C2040712D5. The Gwent product is an organo-silver compound in an aromatic hydrocarbon solvent. The solution can be dried at room temperature and then fired at 150° C. for 1 hour.

The ink solution 50 and/or the ink solution 70 can instead comprise nanoparticles, such as nanometal particles, or nanometals particles.

Some examples of nanoparticle solutions are Novacetrix Metalon aqueous silver inks (JS-015 and JS-011) which comprise nanosilver particles having a 200 nm-400 nm size range. These ink solutions become highly conductive as they dry, and additional thermal or light-pulse curing can further increase conductivity. Another example of a nanoparticle ink solution is Novacetrix Metalon aqueous copper ink (ICI-003) which comprises copper nanoparticles having a particle size of 143 nm.

Other examples of nanoparticle ink solutions include cyclohexane-based NanoSilver ink of NanoMas (10-30% Ag, particle size 2-10 nm), Methode Electronics nanosilver inks, and UT nanosilver and nanogold inks. The NanoMas ink solution can accommodate relatively low curing temperatures (100-150° C.) and the Methode Electronics ink can be cured at ambient temperature immediately after exiting the printer.

An example of a nanometals ink solution would be one which produces nanoparticles having a copper core and a silver shell (Cucore Agshell). (See e.g., Mater Chem 2009; 19:3057-3062, The Royal Society of Chemistry.)

In the context of the present disclosure, any post-print procedure which establishes or improves electrical conductivity of the trails 51 and/or the ingots 71 can be considered a post-print curing step 60/80. And a method wherein the post-print curing is simultaneously accomplished with printing steps is feasible and foreseeable (e.g., the Methode Electronics ink which cures immediately after exiting the printer).

Ink solutions 50/70 that do not contain metal and/or do not require post-print curing are also possible and contemplated. For example, carbon nanotubes, surface modified to be dispersible as stable suspensions, can be employed as the ink solution 50/70. Such ink solutions are available from NanoLab (e.g., Nink1000 and Nink1100) and would establish carbon conductive paths in the tracks 11.

One may now appreciate the heating element 10 can be printed in a mask-free manner (e.g., drop-on-demand) with existing printing equipment. Although the heating element 10, the substrate 20, the heater 30, the power source 40, the ink solution 50, the curing step 60, the ink solution 70, and/or the curing step 80 have been shown and described with respect to certain embodiments, obvious and equivalent alterations and modifications will occur to others skilled in the art upon the reading and understanding of this specification.

The terminology used herein is for the purpose of describing particular embodiments only and is not intended to be limiting of the invention. While the description of the present invention has been presented for purposes of illustration and description, it is not intended to be exhaustive or limited to the invention in the form disclosed. Many modifications, variations, alterations, substitutions, or equivalent arrangement not hereto described will be apparent to those of ordinary skill in the art without departing from the scope and spirit of the invention. Additionally, while various embodiment of the invention have been described, it is to be understood that aspects of the invention may include only some of the described embodiments. Accordingly, the invention is not to be seen as limited by the foregoing description, but is only limited by the scope of the appended claims.

The invention claimed is:

1. A method of making a heating element adapted to provide a power density of at least 400 watts per square meter, the method comprising:

printing directly on a substrate a trail with an ink solution for each track in the heating element, wherein each track establishes an electrically conductive path free of polymer binders inside the electrically conductive path;

wherein the ink solution includes:

a particle-free metal compound and a solvent in which the particle-free metal compound is dissolved.

2. The method as set forth in claim 1, wherein the printing is performed in a mask-free manner.

3. The method as set forth in claim 1, wherein the printing is performed with non-substrate-contacting dispensers.

4. The method as set forth in claim 1, wherein the printing is performed with a thermal inkjet printer, a piezoelectric inkjet printer, an aerosol jet printer, or an ultrasound printer.

5. The method as set forth in claim 1, further comprising:

post-print curing the trail to produce a printed track, wherein the post-print curing comprises:

fusing, sintering, decomposing, and/or firing; or drying, evaporating, or otherwise dismissing substances which are not electrically conductive; or exposure to radiation; or application of electrical power; or addition of chemical agents.

6. The method as set forth in claim 5, wherein the post-print curing is accomplished at temperatures between 20° C. to 25° C.

7. The method as set forth in claim 5, wherein the post-print curing is accomplished at temperatures between 50° C. to 400° C.

8. The method as set forth in claim 5, wherein the post-print curing is accomplished at temperatures between 100° C. to 150° C.

* * * * *